US005926780A

United States Patent [19]

Fox et al.

[11] Patent Number: 5,926,780

[45] Date of Patent: Jul. 20, 1999

[54] SYSTEM FOR MEASURING THE INITIAL VELOCITY VECTOR OF A BALL AND METHOD OF USE

[75] Inventors: Tweed Fox, 11614 Chippenham Way, San Diego, Calif. 92128; Christopher W. Coyle, Valley Center, Calif.

[73] Assignee: Tweed Fox, San Diego, Calif.

[21] Appl. No.: 08/947,887

[22] Filed: Oct. 9, 1997

[51] Int. Cl.[6] ..... A63B 69/00

[52] U.S. Cl. ..... 702/142; 702/150; 473/140; 473/152

[58] Field of Search ..... 702/94, 96, 142, 702/149–150; 473/131, 140, 150–156, 197–199; 434/252; 701/7, 14, 207, 201; 342/107, 109, 113–114

[56] References Cited

U.S. PATENT DOCUMENTS

| | | | |
|---|---|---|---|
| 3,685,909 | 8/1972 | Schwartz | 324/178 |
| 4,858,922 | 8/1989 | Santavaci | 473/197 |
| 4,858,934 | 8/1989 | Ladick et al. | 473/220 |
| 5,108,105 | 4/1992 | Shimizu | 473/225 |
| 5,209,483 | 5/1993 | Gedney et al. | 473/223 |
| 5,226,660 | 7/1993 | Curchod | 473/155 |
| 5,257,084 | 10/1993 | Marsh | 473/223 |
| 5,401,026 | 3/1995 | Eccher et al. | 342/109 |
| 5,413,345 | 5/1995 | Nauck | 434/252 |
| 5,437,457 | 8/1995 | Curchod | 473/199 |
| 5,513,841 | 5/1996 | Takagi | 473/153 |
| 5,588,919 | 12/1996 | Nakamura | 473/212 |

*Primary Examiner*—John Barlow
*Assistant Examiner*—Bryan Bui
*Attorney, Agent, or Firm*—Timothy T. Tyson; Ted Masters; Freilich, Hornbaker & Rosen

[57] ABSTRACT

A system 20 for measuring the initial velocity vector of a ball 500 includes a first light sensing array 24, a first light source 28, a second light sensing array 30, and a second light source 32. The ball 500 has an initial position 22. When the ball 500 is struck, at time T1 it casts a first shadow position 36 on first light sensing array 24, and at time T2 it casts a second shadow position 42 on second light sensing array 30. A first plane 38 is formed by initial position 22, first light source 28, and first shadow position 36. A second plane 44 is formed by initial position 22, second light source 32, and second shadow position 42. The line of flight 37 of ball 500 is defined by the intersection of planes 38 and 44. A slant distance $D_s$ is determined, whereby the speed $S_b$ of ball 500 is defined as $S_b=D_s/(T2-T1)$. The velocity vector is then $S_b$ in the direction of line of flight 37.

15 Claims, 19 Drawing Sheets

SYSTEM FOR MEASURING THE INITIAL VELOCITY VECTOR OF A BALL AND METHOD OF USE

TECHNICAL FIELD

The present invention pertains to devices for measuring the initial path and speed of a ball, such as a golf ball, and more particularly to devices that employ light sensors and timing circuits to determine the position of the ball as a function of time.

BACKGROUND ART

Devices for calculating the path and velocity of a ball are well known in the art. In the game of golf, such devices are utilized to determine the azimuth, elevation, and velocity of a struck golf ball. These devices typically utilize sensors to detect the position of the golf ball just after it is struck by a golf club, and timers to translate the position into a velocity vector. A related category of devices calculate the position and velocity of a golf club head as it strikes a golf ball. For example, U.S. Pat. No. 3,945,646 describes an athletic swing measurement system and method. Multiple accelerometers are positioned in the club so as to measure acceleration in directions normal and parallel to the face and parallel to the shaft. U.S. Pat. No. 4,136,387 shows a golf club impact and golf ball launching monitoring system. Electro-optical sensors measure the location of a plurality of spots on the surface of a golf club head or a golf ball at a minimum of two precisely spaced points in time. From the apparent displacements of the plurality of spots between measurements, the apparatus determines in substantially real time the velocity of the club head or ball and the spin about orthogonal axes. U.S. Pat. No. 4,146,230 defines an electronic golf trainer with golf club head selection. The invention is a golf teaching apparatus in which a student swings a golf club over a target area having photocells. The outputs from the photocells are analyzed and displayed to give an indication of yardage and the faults in the student's swing. U.S. Pat. No. 4,542,906 depicts a computer aided golf training device for detecting movement of a golf ball and club head. The apparatus includes a supporting body which extends toward the golf ball traveling direction. On one side of the supporting body first and second optical signals are output, on the other side the signals are detected. First and second light signals are discriminated by analysis of their detected different phases, and this data is used to analyze ball movement. U.S. Pat. No. 4,844,469 discloses a golf trainer for calculating ball carry. The device includes magnetic sensors for detecting the passage of a golf club head and is provided with a device for electronically measuring the speed of the club. The carry of the ball is also calculated from data regarding the club selected and the characteristics of the speed of this club versus the carry of the ball. U.S. Pat. No. 4,858,922 comprises a method and apparatus for determining the velocity and path of travel of a ball. A pair of velocity sensing devices are disposed on opposite sides of the proposed path of travel of a ball with the electromagnetic energy beams from the devices directed at acute angles to the proposed path of travel. Velocity signals generated by the two devices are averaged and converted to visible messages concerning the speed of the ball and its likely distance of travel had its flight not been interrupted. Velocity signals are also compared to generate a visible message concerning the deviation of the actual path of travel of the ball from the proposed path of travel. U.S. Pat. No. 4,858,934 consists of a golf practice apparatus. First, second, and third sensor signals are employed for computing a golf ball flight and providing corresponding output signals to a monitor for providing a visual representation of the flight of the golf ball. U.S. Pat. No. 4,940,236 describes a computer golf club. A golf ball distance computer is built entirely into the golf club utilizing a molecularly polarized piezoelectric plastic film composite as a ball impact transducer. U.S Pat. No. 5,062,641 includes a projectile trajectory determination system. The system determines the location of the point of impact of a projectile, such as a golf ball, on a screen. The screen is impacted by a projectile and the point of impact on the screen is accurately determined by acoustical means. U.S. Pat. No. 5,146,557 shows a user interface for a golf green and a golf putt modeling system. The interface includes actuators which allow a user to select camera positions and illumination of a golf green. The user also may select, using the interface, a location of a golf ball and a golf cup on the green. The interface also displays the path trajectories of the golf ball on the green. U.S. Pat. No. 5,209,483 defines transducing and analyzing forces for instrumented sporting devices and the like. The device characterizes the trajectory followed by a movable object after a piece of sporting equipment comes into contact with the movable object. The device includes at least one force sensor element arranged to be located on the piece of sporting equipment, which is held or worn by the user. U.S. Pat. No. 5,257,084 defines a golf swing measurement system. The system includes a technique for measuring golf swing tempo or club head speed for a golfer swinging a golf club through a tee area. Two parallel infrared (IR) transmitters transmit respective IR beams along predetermined lines toward the tee area. U.S. Pat. No. 5,390,927 depicts a golf simulator having a system for calculating the slice/hook component of the ball trajectory. The simulator includes a target screen that receives a projected image of a golf hole from a player's view. As the player hits a ball into the target screen, a main controller analyzes the swing and displays the path of the golf ball using a spotlight generated by a tracer. U.S. Pat. No. 5,398,936 discloses a golfing apparatus and method for golf play simulation. The device has a golf shot file providing a representation of at least one actual golf shot by the user. The golf shot representation includes at least a time and a distance of a golf ball travel. U.S. Pat. No. 5,401,026 comprises a method and apparatus for determining parameters of the motion of an object. In one embodiment, the device can be used to calculate the estimated carry distance of a golf shot. The golfer uses a keypad to enter the golf club and the units of measure for the output display. A Doppler radar system is employed to illuminate the golf ball. A reflected return signal is detected and difference pulses are generated, having a frequency which is proportional to the velocity of the ball. U.S. Pat. No. 5,413,345 consists of a golf shot tracking and analysis system. The system utilizes an array of high speed video cameras with image processors coupled to data microprocessors, data memory devices, video monitors, control terminals, printout devices, and related hardware and software. U.S. Pat. No. 5,437,457 portrays a golf ball trajectory and spin sensing system. The trajectory sensing system includes a first row of light sensors located adjacent to a tee and receiving light from a first light source directly above the tee. Second and third rows of light sensors are positioned away from the tee. The second row receives light from a second source directly overhead. The third row receives light from the first light source where a plane of light is defined between the first light source and the third light source. The time intervals between a golf ball passing from the tee to the first plane of light and to the second plane of light, where the second plane of light is define by the second light source and the second row of sensors are detected by the first, second and third rows of light sensors. The angle of elevation of a golf ball is determined as a function of the ratio of the first and second time intervals. U.S. Pat. No. 5,472,205 describes an opto-electric golf club swing sensing system and method. The system includes a video game operating on a personal computer having a monitor, a microprocessor, and a serial port. A golf club swing sensing system is coupled to the personal computer through the serial port. The sensing system is mounted on a pad and includes a linear array of photodetectors for detecting a club head offset angle relative to a desired club head axis by sensing reflected light off the underside of the club head. U.S. Pat. No. 5,489,099 shows an apparatus and method for tracking the flight of a golf ball. The apparatus has a video camera for producing data representative of video images of a golf ball, a video frame processor connected to receive data from the video camera for determining the golf ball image position within a video frame of the camera, a flight path predictor responsive to the video frame processor for predicting the flight path of the golf ball in response to data from the video frame processor, and a motion controller responsive to the flight path predictor for controlling the movement of the camera to thereby track the actual flight of the golf ball.

DISCLOSURE OF INVENTION

The present invention is directed to system for measuring the initial velocity vector of a ball, such as a golf ball after it is struck. The present invention is unique in that does not utilize time interval data to calculate the line of flight of the ball. Rather, the intersection of two planes determines the line of flight. The speed of the ball along the line of flight, velocity vector, is then determined separately from time interval data.

In a preferred embodiment of the invention, the ball has an initial position. A first light source is directed toward a first light sensing array having a plurality of light sensors. After being struck, at time T1 the ball has a first position interposed between the first light sensing array and the first light source. The ball casts a first shadow position on the first light sensing array which includes a shadow cast upon at least one light sensor. A first plane is defined by (1) the initial position, (2) the first shadow position, and (3) the first light source. A second light source is directed toward a second light sensing array having a plurality of light sensors. The second light sensing array is oriented substantially parallel to and disposed a predetermined distance D from the first light sensing array. At time T2 the ball has a second position interposed between the second light sensing array and the second light source. The ball cast a second shadow position on the second light sensing array, which includes a shadow cast on at least one light sensor. A second plane is defined by (1) the initial position, (2) the second shadow position, and (3) the second light source. The initial line of flight is then defined by the intersection of the first plane with the second plane.

In accordance with an important aspect of the invention, the system includes a means for ensuring that the maximum number of light sensors are shadowed. A delay circuit is included which delays the measurement of the first and second shadow positions until the ball is substantially directly over the first and second light sensing arrays respectively.

In accordance with an important feature of the invention, a slant distance $D_s$ is measured from the position of the ball at time T1 to the position of the ball at time T2. The initial speed of the ball $S_b$ is defined by the equation $S_b=D_s/(T2-T1)$. The initial velocity vector is then defined as the speed of the ball $S_b$ along the line of flight.

In accordance with another important aspect of the invention, the system further includes a first club head light source directed at a first club head light sensor. At time T3, a golf club head has a first position interposed between the first club head light sensor and the first club head light source. A second club head light source is directed at a second club head light sensor disposed a predetermined distance $D_c$ from the first club head light sensor. At later time T4, the golf club head has a second position interposed between the second club head light sensor and the second club head light source. The golf club head speed $S_c$ is defined by the equation $S_c=D_c/(T4-T3)$.

In accordance with another aspect of the invention, time intervals T2−T1 and T4−T3 are measured by a timer card.

In accordance with another feature of the invention, the golf club head speed $S_c$ must be greater than a predetermined value.

In accordance with another aspect of the invention, the ball speed $S_b$ must be a predetermined amount greater than the golf club head speed $S_c$.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
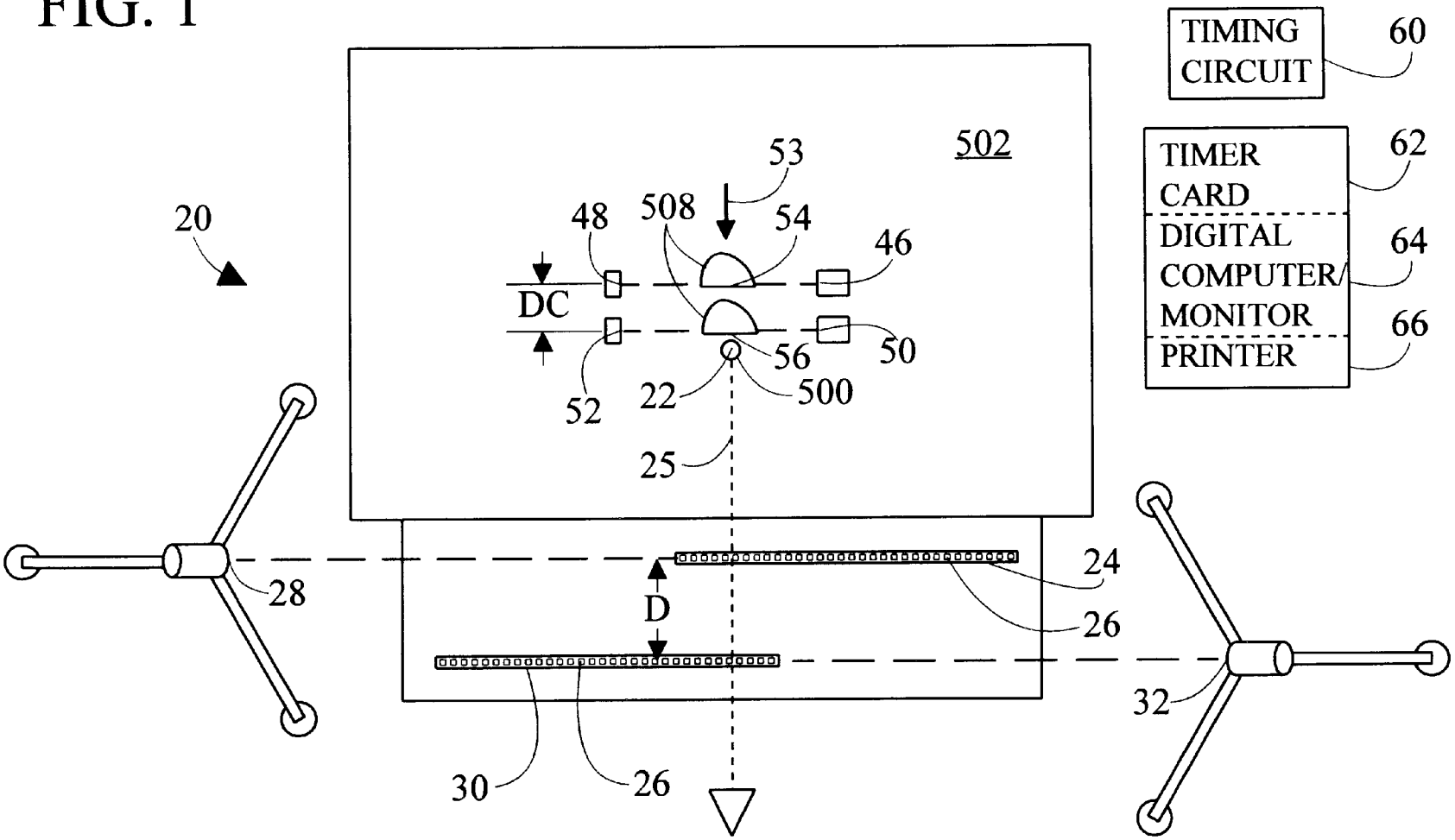
FIG. 1 is a top plan view of a system for measuring the initial velocity vector of a ball in accordance with the present invention.
Figure 2:
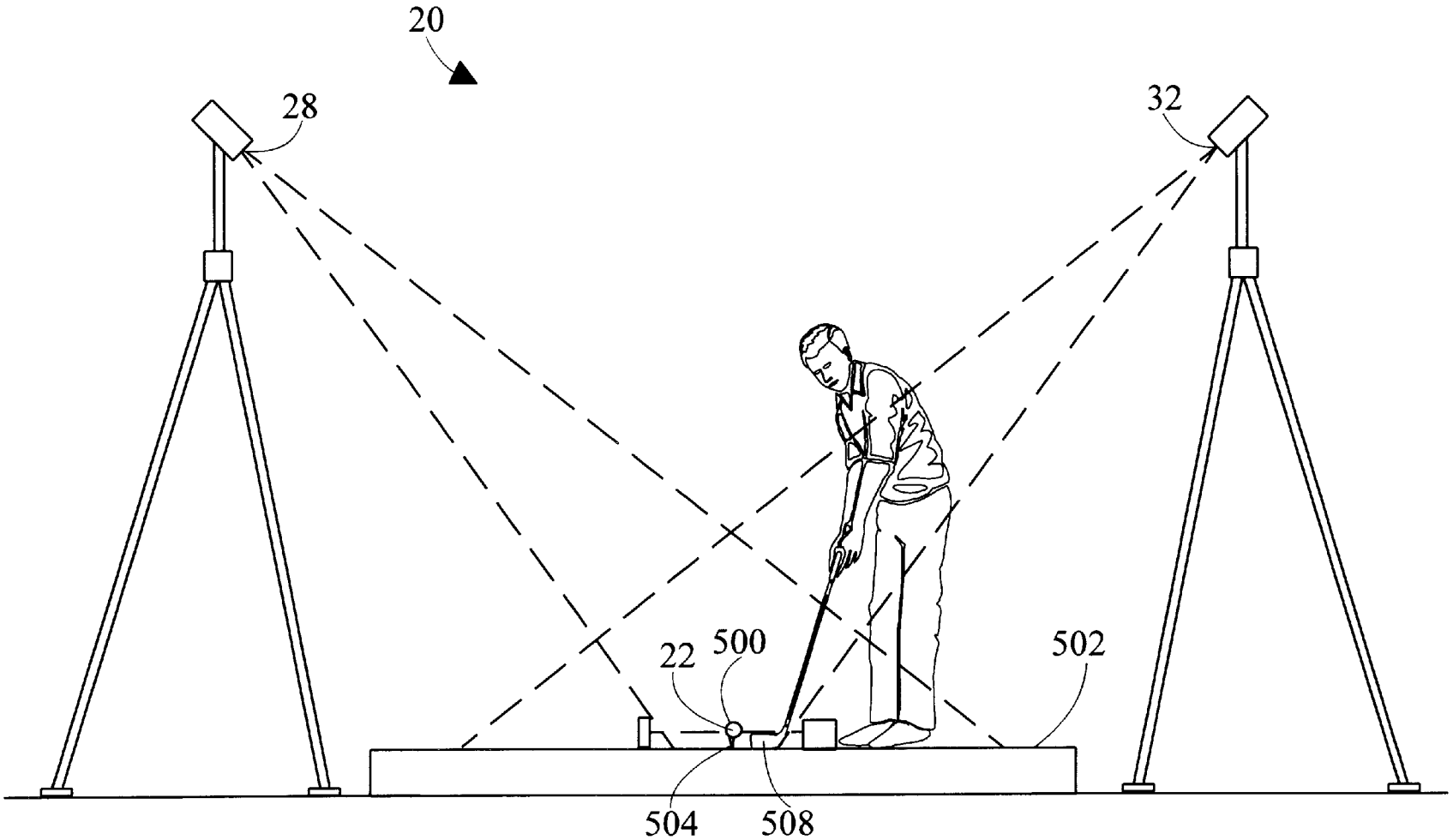
FIG. 2 is a front elevation view of the system.

Referring initially to FIGS. 1 and 2, there are illustrated a top plan view, and a front elevation view of a system for measuring the initial velocity vector of a ball in accordance with the present invention, generally designated as 20. The initial velocity vector is comprised of a line of flight consisting of azimuth and elevation components, and an initial speed. In the shown embodiment the ball 500 is a golf ball, however it may be readily appreciated that with appropriate design adjustments, other types of balls or other objects could also be measured. Ball 500 is in an initial position 22 on a playing surface 502. Ball 500 may be placed directly upon playing surface 502, or may be elevated by a golf tee 504. Ball 500 has a nominal path of travel 25. A first light sensing array 24 has a plurality of light sensors 26 arranged in a substantially linear array. A first light source 28 is directed toward first light sensing array 24. The individual light sensors 26 each have a field of view which can be steered by the use of an aperture plate. Proper adjustment of the aperture plate allows the light sensors 26 to receive light from the first light source 28, but not from the sun or other light sources.

A second light sensing array 30 also has a plurality of light sensors 26 arranged in a substantially linear array. Second light sensing array 30 is oriented substantially parallel to first light sensing array 24, and is disposed a distance D from first light sensing array 24. A second light source 32 is directed toward second light sensing array 30. In a preferred embodiment, first light sensing array 24 and second light sensing array 30 each have 32 individual light sensors 26. Also in a preferred embodiment, light sources 28 and 32 are in common vertical planes with light sensing arrays 24 and 30 respectively. In FIG. 2, rays have been drawn from each light source 28 and 32 to the end light sensors 26 of the respective light sensing arrays 24 and 30 respectively. As ball 500 is struck and leaves its initial position 22, it passes through the diamond shaped region formed by the intersecting of the rays. If it does so, it necessarily cast a shadow upon each of the arrays and sufficient data becomes available to fully determine the line of flight of ball 500. In a preferred embodiment, light sources 28 and 32 are approximately 14 feet above playing surface 502.

Figure 3:
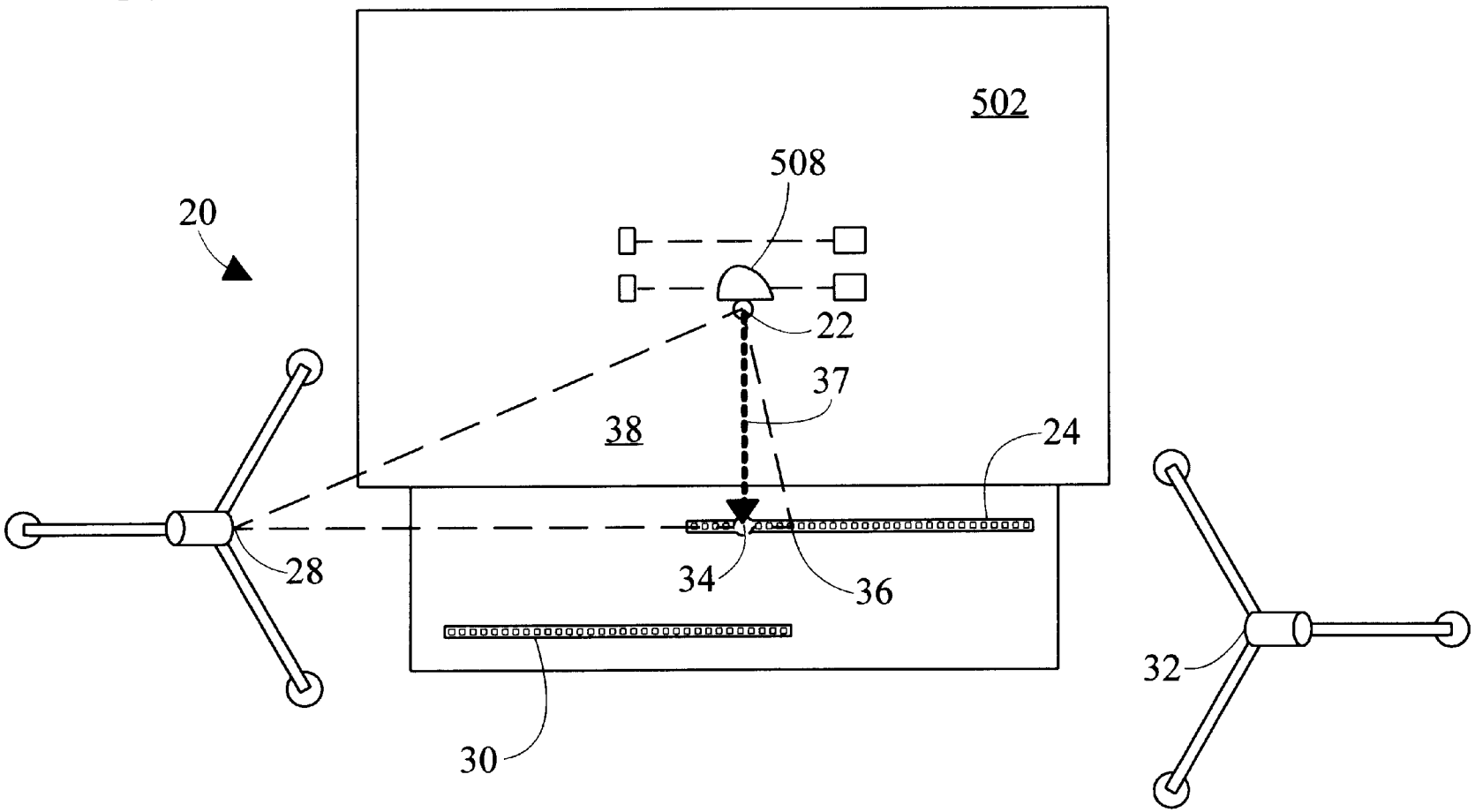
FIG. 3 is a top plan view showing a first plane.

Referring to FIG. 3, ball 500 is struck by golf club head 508 and resultantly travels along line of flight 37. At time T1 ball 500 has a first position 34 which is interposed between first light sensing array 24 and first light source 28. A first shadow position 36 on first light sensing array 24 is caused by ball 500 being interposed between first light sensing array 24 and first light source 28. Usually two, and at most four, light sensors 26 will sense the shadow cast by ball 500. A first plane 38 is defined by (1) the initial position 22 of ball 500, (2) the first shadow position 36, and (3) the first light source 28. It may be appreciated, that line of flight 37 lies completely on first plane 38.

Figure 4:
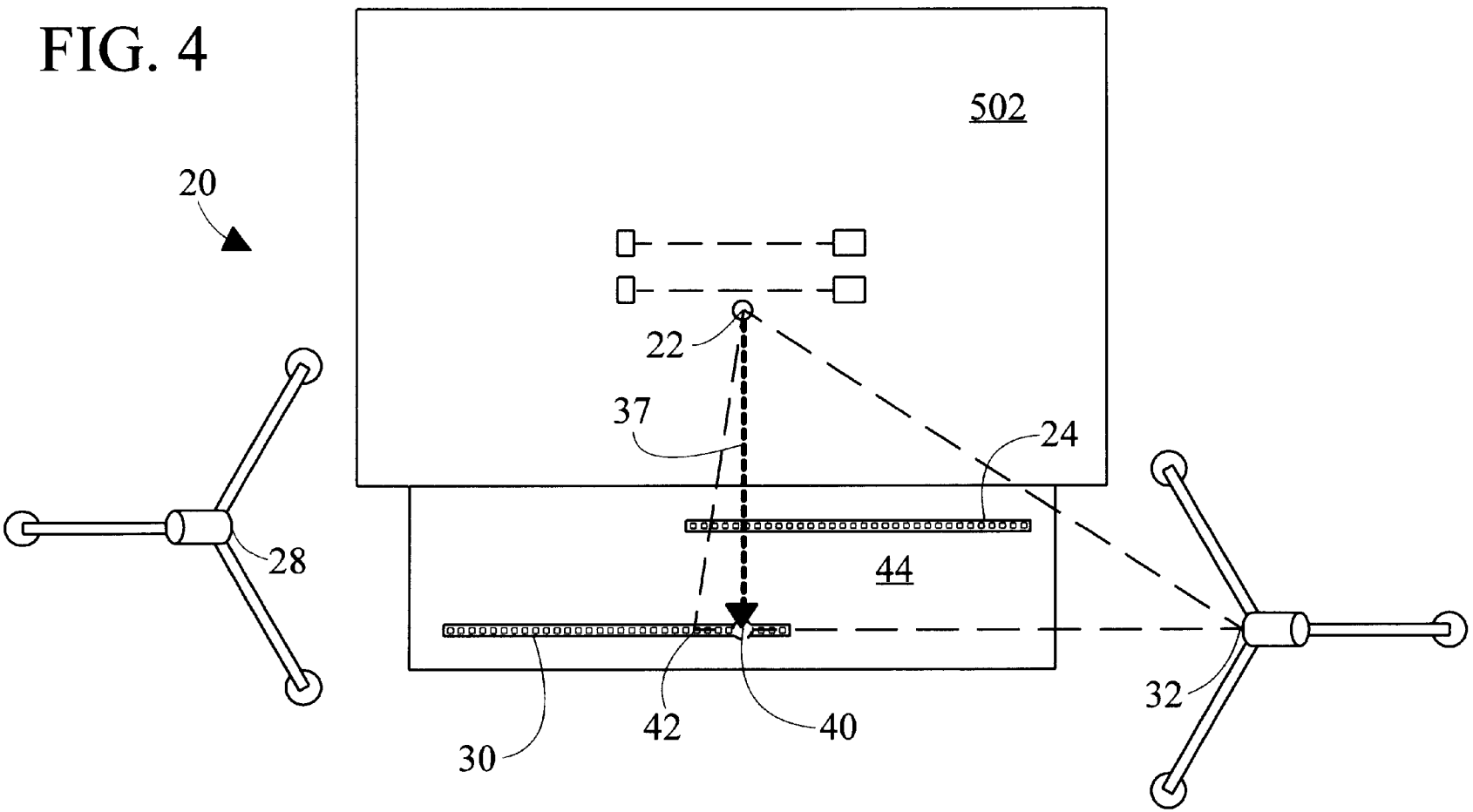
FIG. 4 is a top plan view showing a second plane.

Referring to FIG. 4, at later time T2, ball 500 has a second position 40 along line of flight 37 which is interposed between second light sensing array 30 and second light source 32. A second shadow position 42 on second light sensing array 30 is caused by ball 500 being interposed between second light sensing array 30 and second light source 32. Again, usually two, and at most four, light sensors 26 will sense the shadow cast from golf ball 500. A second plane 44 is defined by (1) the initial position 22 of ball 500, (2) the second shadow position 42, and (3) the second light source 32. It may be appreciated, that line of flight 37 also lies completely on second plane 44.

Figure 5:
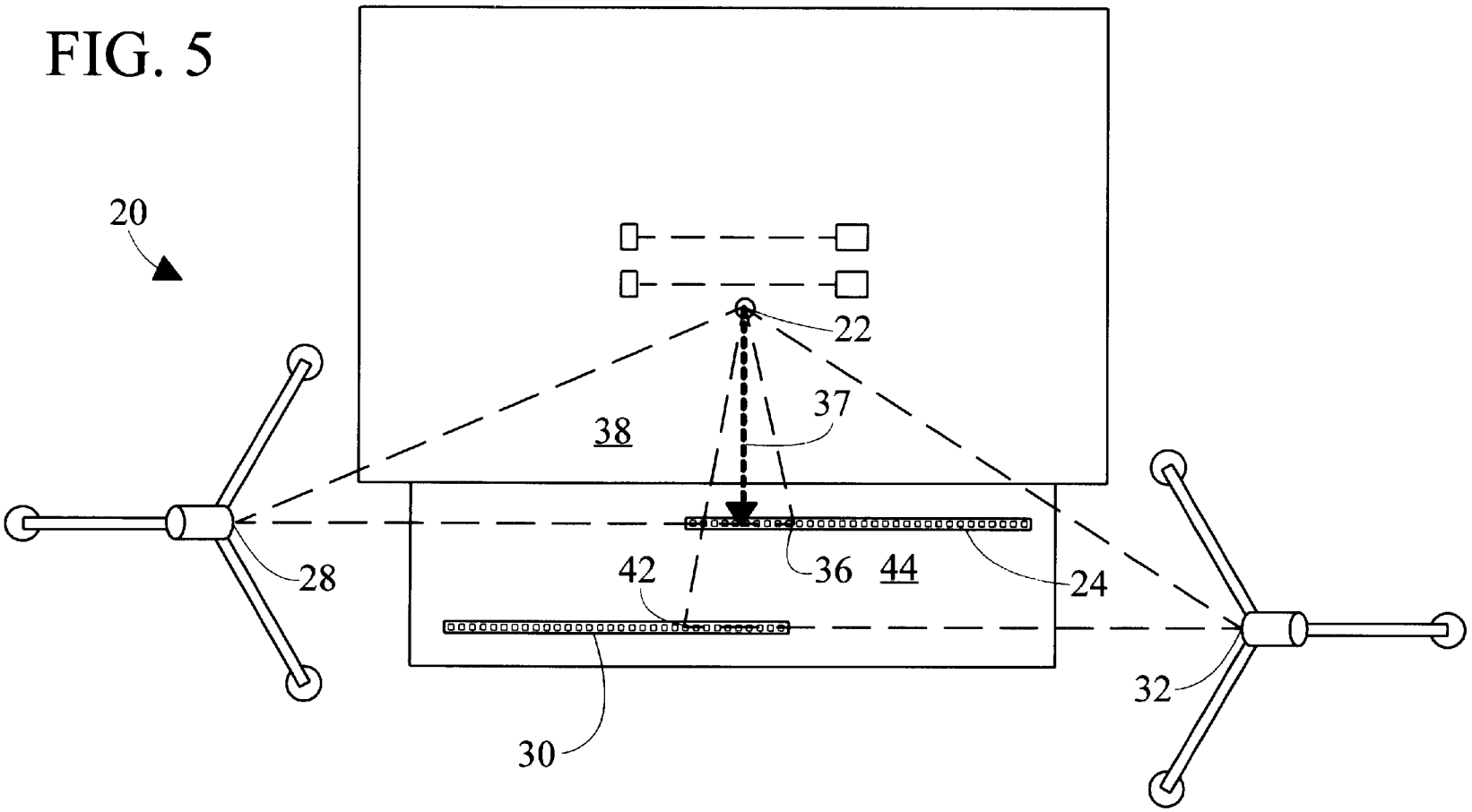
FIG. 5 is a top plan view showing the intersection of the first plane and the second plane.
Figure 6:
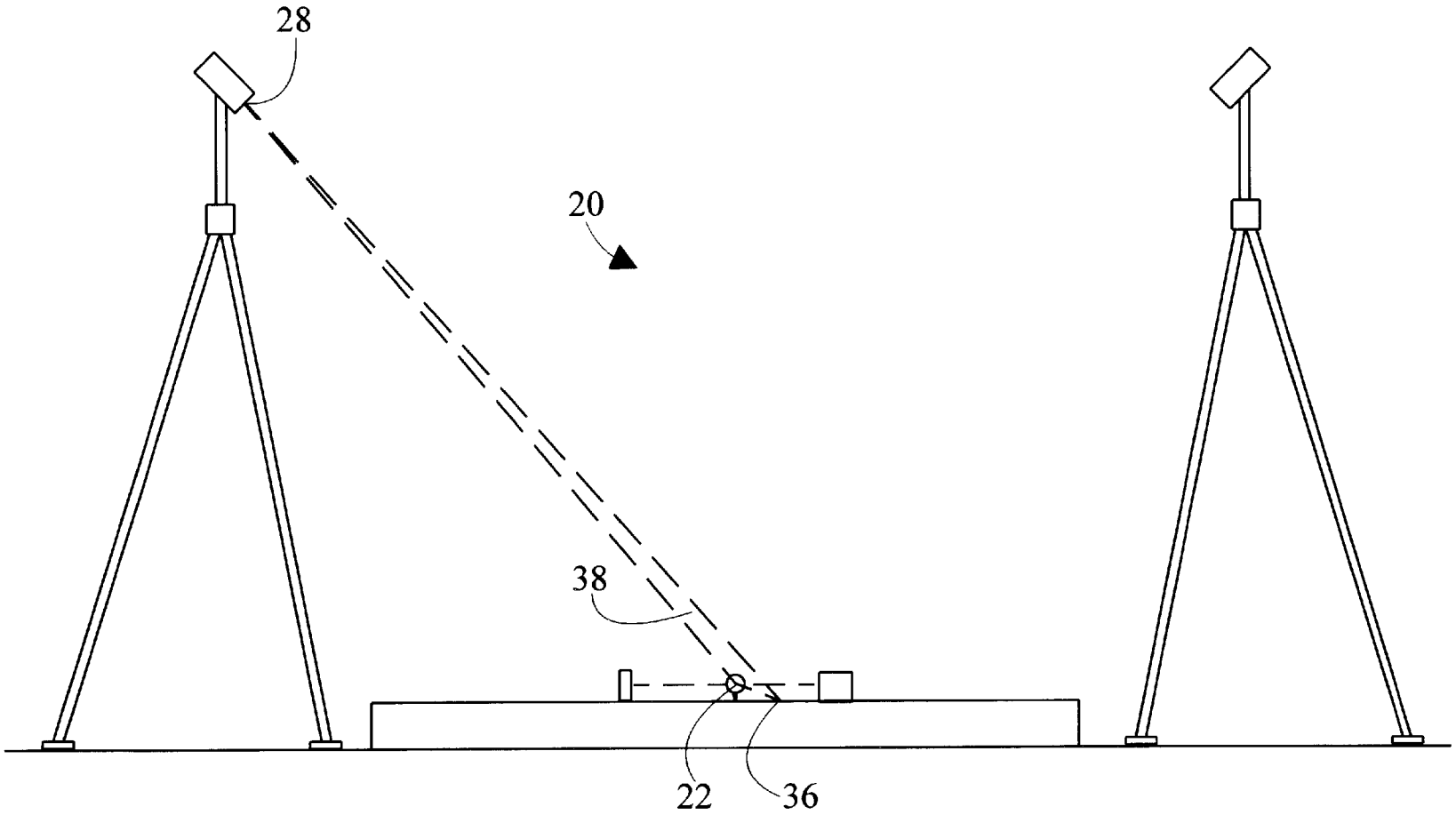
FIG. 6 is a front elevation view showing the first plane.
Figure 7:
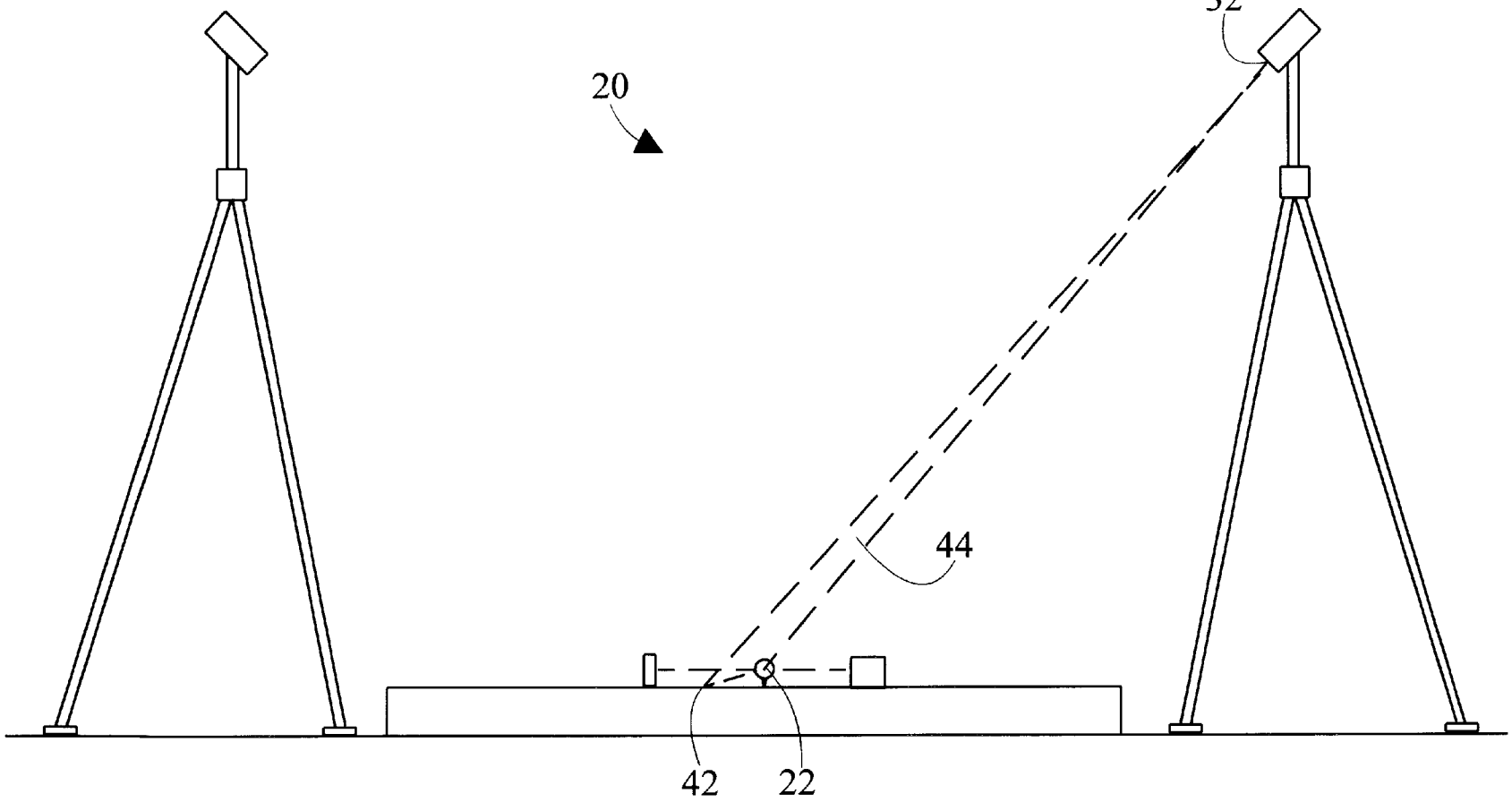
FIG. 7 is a front elevation view showing the second plane.
Figures 8, 9:
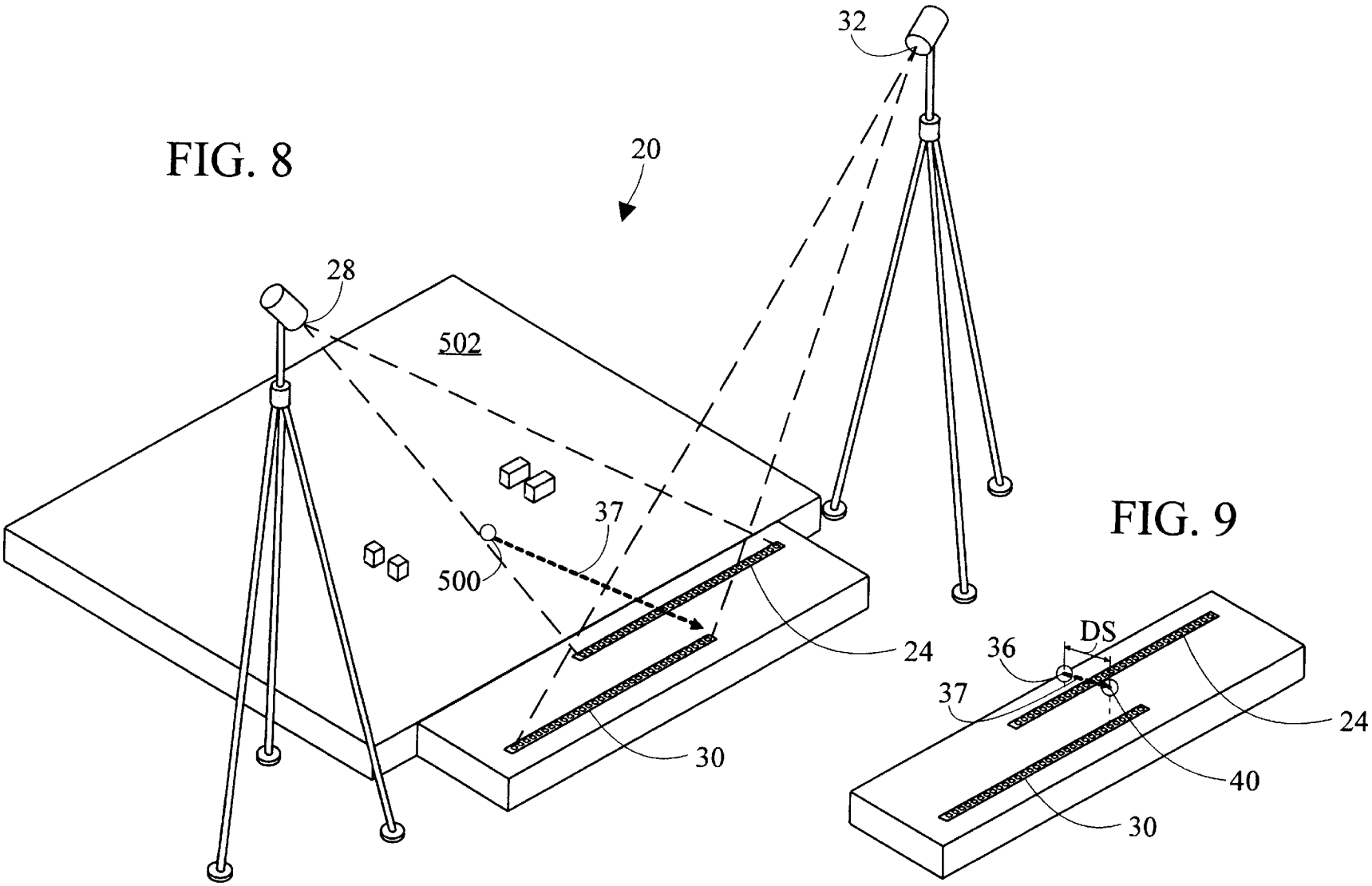
FIG. 8 is a perspective view of the system.
FIG. 9 is a perspective view of first and second light sensing arrays.

Now referring to FIG. 5, it may be seen that since line of flight 37 lies completely in both planes 38 and 44, the initial line of flight 37 must be defined by the intersection of first plane 38 with second plane 44. The line of flight 37 can also be described in terms of azimuth and elevation angles if desired. FIG. 6 provides a front elevation view showing first plane 38, and FIG. 7 provides a front elevation view showing second plane 44. FIG. 8 is a perspective view of system 20 showing first light source 28, second light source 32, first light sensing array 24, second light sensing array 30, playing surface 502, ball 500, and initial line of flight 37.

FIG. 9 is a perspective view of light sensing arrays 24 and 30. At time T1, ball 500 is at first position 36 directly above first light sensing array 24 and is interposed between first light sensing array 24 and first light source 28 at time T1. At a slightly later time T2, ball 500 is at second position 40 directly above second light sensing array 30 and is interposed between second light sensing array 30 and second light source 32. Slant distance $D_s$ is the distance from first position 36 to second position 40, along initial line of flight 37. The initial speed of the ball $S_b$ is then defined by the equation $S_b=D_s/(T2-T1)$. The slant distance $D_s$ is calculated based upon the initial line of flight 37 using standard principles of analytic geometry. The initial velocity vector is then comprised of initial speed $S_b$ directed along the initial line of flight 37.

Referring again to FIG. 1, ball 500 is struck by a golf club head 508. First club head light source 46 is directed toward first club head light sensor 48. Second club head light source 50 is directed toward second club head light sensor 52. The light from first club head light sensor 46 and second club head light sensor 50 is substantially perpendicular to nominal path of travel 25. Second club head light sensor 52 is disposed a predetermined distance $D_c$ from first club head light sensor 48. As the golf club head 508 is swung toward ball 500 in direction 53, at time T3 golf club head 508 has a first position 54 interposed between first club head light sensor 48 and first club head light source 46, and at later time T4 golf club head 508 has a second position 56 interposed between second club head light sensor 52 and second club head light source 50. It is noted that times T3 and T4 occur before previously discussed times T1 and T2. The golf club head speed $S_c$ is then defined by the equation $S_c=D_c/(T4-T3)$.

Figure 10:
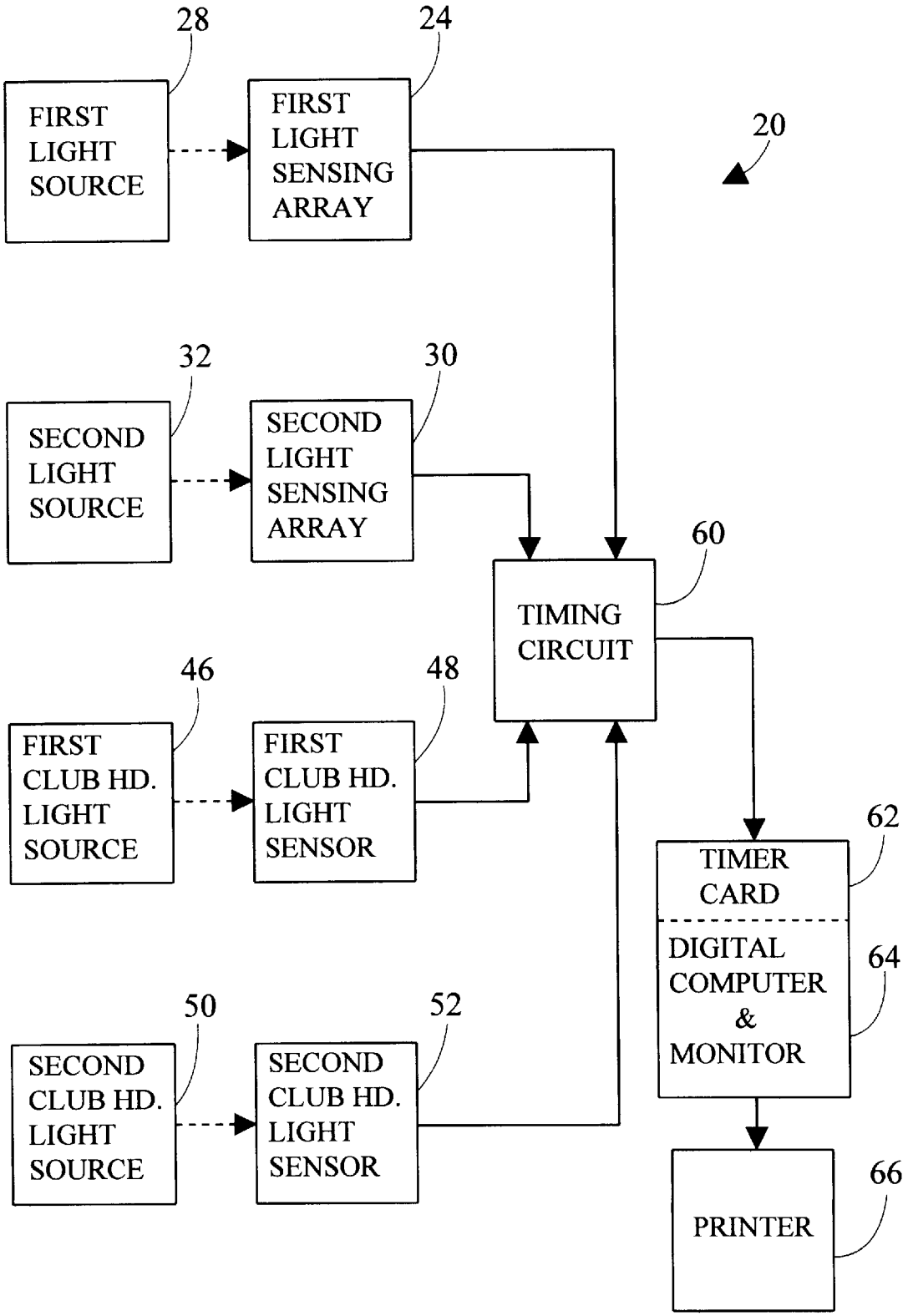
FIG. 10 is a block diagram of the system.

FIG. 10 is a block diagram of system 20. First light source 28 is directed toward first light sensing array 24, and second light source 32 is directed toward second light sensing array 30. The shadow of moving ball 500 is detected by individual light sensors 26, and that information is supplied to a timing circuit 60 which converts the ball's 500 shadow into timing pulses. The timing pulses are then routed to a timer card 62 which directly measures the width of the ball's 500 shadow. Using the measurements provided by timer card 62, digital computer/monitor 64 then calculates:

the initial line of flight of the ball
the initial speed of the ball
the initial ball elevation angle
the initial ball azimuth angle
predicted ball range
predicted ball carry The initial line of flight, elevation angle, and azimuth angle are calculated in accordance with standard principles of analytic geometry based upon the intersection of planes 38 and 44.

Printer 66 provides hard copies of this information.

Figure 11:
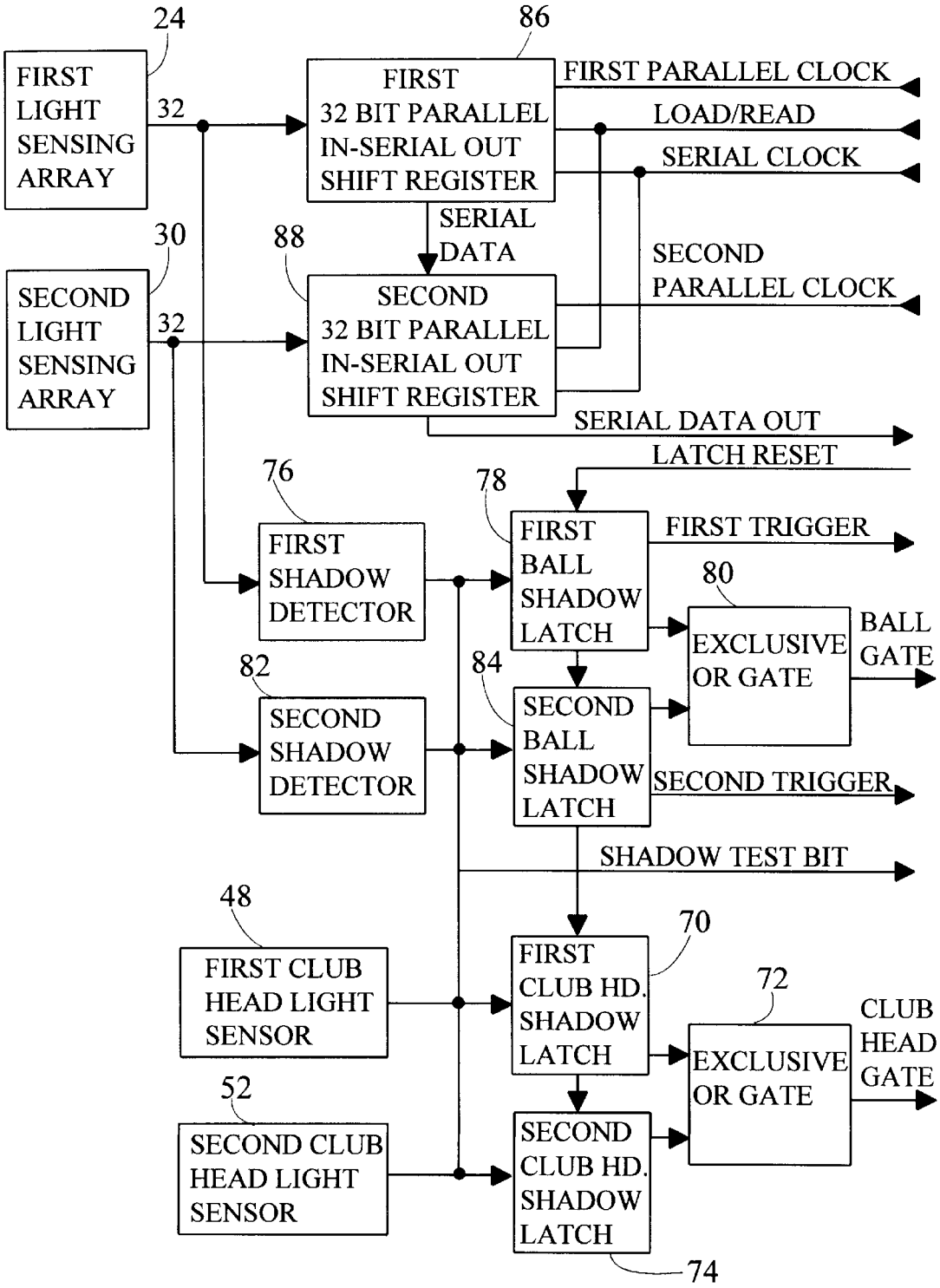
FIG. 11 is a block diagram of a timing circuit.

FIG. 11 is a block diagram of a timing circuit 60. In the quiescent state of waiting for a golf club to be swung, all light sensors 26 (refer to FIG. 1) of first light sensing array 24, second light sensing array 30, first club head light sensor 48, and second club head light sensor 52 are illuminated and supply a logical TRUE output. During the swing of golf club head 508 (refer to FIG. 1) the first detected shadow occurs at first club head light sensor 48 at time T3, wherein the logical TRUE becomes a logical FALSE. First club head shadow latch 70 senses the transition from TRUE to FALSE and changes the state of its output from FALSE to TRUE. This latch state is a permanent indication of the transition of first club head light sensor 48, and remains even when illumination is restored to first club head light sensor 48. Following first club head shadow latch 70 is an exclusive OR gate 72 that sets a CLUB HEAD GATE TRUE when one and only one of its inputs are TRUE. The CLUB HEAD GATE will therefore stay TRUE until second club head light sensor 52 senses the club head and causes the output of second club head shadow latch 74 to transition from FALSE to TRUE. The CLUB HEAD GATE signal is therefore a pulse equal in width to the time interval (T4−T3) between occurrences of club head shadows at first and second club head light sensors 48 and 52 respectively. A timer on commercially available timer card 62 (refer to FIGS. 1 and 11) is programmed by software to directly measure the width of the CLUB GATE, and subsequently make this signal available to software running in digital computer 64 (refer to FIGS. 1 and 11). The software has access to a parameter $D_s$ representing the physical distance between the detected shadows. The ratio of this distance $D_s$ to the measured time interval T4−T3 is an estimate of club head speed $S_c$. This estimate is most indicative of club head 508 speed at impact with the ball 500 if second club head light sensor 52 is as close as possible to the point at which the club head 508 contacts the ball 500.

Following impact with the ball 500, the next event of interest occurs when first light sensing array 24 detects the shadow of ball 500. This shadow will initially be present on usually one and at most two of the individual light sensors 26 of first light sensing array 24, causing these sensors to transition from TRUE to FALSE. When any of the inputs to first shadow detector 76 become FALSE, its output becomes FALSE. First ball shadow latch 78 senses the transition of its input from TRUE to FALSE and changes the state of its output from FALSE to TRUE. This latch is a permanent indication of the event at first light sensing array 24, and remains even when illumination is restored to all light sensors 26 of first light sensing array 24. Following first ball shadow latch 78 is an exclusive OR gate 80 that sets a BALL GATE TRUE when one and only one of its inputs are TRUE. The BALL GATE will therefore stay TRUE until second light sensing array 30 senses the shadow of ball 500 and causes the output of second shadow detector 82 to transition from TRUE to FALSE. Second ball shadow latch 84 then transitions from FALSE to TRUE. This causes exclusive OR gate 80 to transition from TRUE to FALSE. The BALL GATE signal is therefore a pulse equal in width to the time interval (T2−T1) between occurrences of ball 500 shadows at first and second light sensing arrays 24 and 30 respectively. Timer card 62 (refer to FIGS. 1 and 11) is programmed by software to directly measure the width of the BALL GATE, and subsequently make this signal available to software running in digital computer 64 (refer to FIGS. 1 and 11). Once the distance $D_s$ travelled by the ball 500 between the first light sensing array 24 and second light sensing array 30 is known, the ratio of distance to the measured time (T2−T1) is an estimate of the ball 500 speed $S_b$. The calculation of distance $D_s$ must await the calculation of initial line of flight 37 discussed below. It is noted that the first ball, second ball, first club head, and second club head shadow latches can be RESET by software through the parallel output port of timer card 62 any time before the next swing.

All sensors 26 of first light sensing array 24 and second light sensing array 30 are wired to (1) first and second 32-bit parallel in-serial out shift registers 86 and 88 respectively, and (2) first and second shadow detectors 76 and 82 respectively. Each of these shift registers is capable, upon application of a pulse, of simultaneously latching and storing all data being output by its associated light sensing array at the time of the pulse. This is effectively a "snapshot" of the shadowed state of the light sensing arrays. The timing of this "snapshot" is such that the ball 500 shadow is directly over a light sensing array when it occurs. First and second ball shadow latches 78 and 84 respectively, produce a FIRST TRIGGER and a SECOND TRIGGER coincident with their entering a set TRUE state. A pair of timers on timer card 62 have been programmed by software to issue FIRST PARALLEL CLOCK and SECOND PARALLEL CLOCK pulses in turn to first shift register 86 and then second shift register 88, at fixed time intervals after the receipt the FIRST TRIGGER and SECOND TRIGGER. The programmed time interval (delay) approximates the time required for the ball 500 moving at typical speed to traverse a distance equal to its radius. This delay makes it likely that the maximum number of light sensors 26 are shadowed at the time of the "snapshot". This feature improves the accuracy of angular measurement.

The only remaining task involved is the reading of the shadow data by the digital computer software. This is accomplished by software control of the LOAD/READ line on the output port of timer card 62, placing it in the READ state. The SERIAL CLOCK (timer card 60 input port) can then be repetitively toggled, causing a bit stream representing the shadow data to appear on a single SERIAL DATA OUT line of the timer card 62 input port. Both first and second shift registers 86 and 88 are read through the single line, as the serial output of first shift register 86 is wired to the serial input of second shift register 88.

Once the data is available to the software, first and second shadow positions 36 and 42 respectively, defined as the average locations between the left most and right most shadowed light sensors 26 of first and second light sensing arrays 24 and 30 respectively are determined. Ball 500 speed $S_b$, azimuth, and elevation can then be calculated.

The ball's line-of-flight (LOF) is determined by the intersection of two planes, each defined by three points, a ball initial position, a light source location and a shadow location. It is most efficient computationally to immediately express this LOF as the two points in space, $PT_1$ and $PT_2$ where the ball was located when shadowing the first sensor array (at time T1) and the second sensor array (at time T2), respectively. These points are just the intersection of the LOF with two additional (fixed) planes, each defined by the two end sensors of each sensor array and its respective light source. These fixed planes are to be referred as Planes of Illumination. Each point is determined then by intersecting three planes, the two determining the LOF and one Plane of Illumination.

The general form for the equation of a plane is known to be:

$$\Phi_0 x+\Phi_1 y+\Phi_2 z+\Phi_3=0. \quad (1)$$

For each of the four planes used in the computation the $\Phi_n$ will have different values, depending upon the three points used in their respective definitions. The coefficients $\Phi_n$ are known to depend upon the locations of these three points as follows:

$$\Phi_0=(P_{1y}-P_{3y})\ (P_{2z}-P_{3z})-(P_{2y}-P_{3y})\ (P_{1z}-P_{3z}),$$

$$\Phi_1=-(P_{1x}-P_{3x})\ (P_{2z}-P_{3z})+(P_{2x}-P_{3x})\ (P_{1z}-P_{3z}),$$

$$\Phi_2=(P_{1x}-P_{3x})\ (P_{2y}-P_{3y})-(P_{2x}-P_{3x})\ (P_{1y}-P_{3y}),$$

and $$\Phi_3=-P_{3x}\Phi_0-P_{3y}\Phi_1-P_{3z}\Phi_2, \tag{2}$$

where $\{P_{nx}, P_{ny}, P_{nz}\}$ are the rectangular coordinates of the point 'n' in space.

The rectangular coordinates of the two end sensors of each sensor array, as well as those of the two sources, are known at the outset. This data allows the two Planes of Illumination, $PI_1$ and $PI_2$, to be defined immediately. Once a ball shadow location has been determined on each sensor array, the planes determining the LOF, $PL_1$ and $PL_2$, can be defined, the initial ball location being known.

The point $PT_1$ can now be determined by intersecting $PI_1$, $PL_1$ and $PL_2$. Similarly, the point $PT_2$ is determined by intersecting $PI_2$. $PL_1$ and $PL_2$. This involves simultaneously solving three equations of the type given in (1). If these three equations are given as:

$$\Phi_0x+\Phi_1y+\Phi_2z+\Phi_3=0,$$

$$\phi_0x+\phi_1y+\phi_2z+\phi_3=0, \text{ and}$$

$$\lambda_0x+\lambda_1y+\lambda_2z+\lambda_3=0, \tag{3}$$

the three coordinates of the point of intersection are, by Cramer's rule:

$$PT_{nx}=\begin{vmatrix}-\Phi_3 & \Phi_1 & \Phi_2\\ -\phi_3 & \phi_1 & \phi_2\\ -\lambda_3 & \lambda_1 & \lambda_2\end{vmatrix}\Big/D, \tag{4}$$

$$PT_{ny}=\begin{vmatrix}\Phi_0 & -\Phi_3 & \Phi_2\\ \phi_0 & -\phi_3 & \phi_2\\ \lambda_0 & -\lambda_3 & \lambda_2\end{vmatrix}\Big/D, \text{ and}$$

$$PT_{nz}=\begin{vmatrix}\Phi_0 & \Phi_1 & -\varphi_3\\ \phi_0 & \phi_1 & -\phi_3\\ \lambda_0 & \lambda_1 & -\lambda_3\end{vmatrix}\Big/D,$$

where D is given by:

$$\begin{vmatrix}\Phi_0 & \Phi_1 & \Phi_2\\ \phi_0 & \phi_1 & \phi_2\\ \lambda_0 & \lambda_1 & \lambda_2\end{vmatrix}. \tag{5}$$

The ball velocity vector, expressed as speed, azimuth, and elevation, can now be expressed as follows.

$$\text{Speed, } S_b=D_s/(T2-T1), \tag{6}$$

where $$D_s=\{(PT_{2x}-PT_{1x})^2+(PT_{2y}-PT_{1y})^2+(PT_{2z}-PT_{1z})^2\}^{1/2}.$$

To minimize angular measurement errors, angles are computed using the point $PT_2$ and the accurately known initial ball position, defined as $\{0,0,0\}$:

$$\text{Azimuth}=\tan^{-1}(PT_{2x}/PT_{2y}),$$

and $$\text{Elevation}=\tan^{-3}(PT_{2z}/PT_{2y}). \tag{7}$$

As it is possible for an even number of light sensors 26 to be shadowed by ball 500, a shadow position (center) can be determined to lie between a pair of light sensors 26. It is therefore of value in enhancing the resolution of the system 20 to delay the "snapshot" described above until the ball is fully over the light sensing arrays. If no delay were inserted, light sensing array data would always consist of only one shadowed light sensor 26, consistent with the leading edge of the ball 500 shadow contacting the first light sensor 26 to be shadowed. Such data can never result in a shadow center determination anywhere but coincident with a light sensor 26 location.

Many situations are expected to arise during normal operation where shadows are cast on sensor elements in a manner inconsistent with the operational description provided above. Features are provided in software that sense such spurious shadows and cause system 20 to ignore them.

System 20 first expects to measure a club head speed above a predetermined minimum value before proceeding with any ball 500 measurements. A measurement below the minimum, or a premature start of the ball 500 speed counter, results in a system reset transparent to the player. These conditions actually will occur frequently as for example if a shoulder inadvertently shadows one of the light sensing arrays, or if golf club 508 is waggled in front of one of the club head light sensors prior to the swing.

Additionally, the ball 500 speed $S_b$ estimate must be a predetermined amount greater than the club head 508 speed $S_c$ to be reported. This feature prevents the club head 508 from masquerading as the ball 500 in the event the ball 500 does not pass through the diamond shaped active sensing area after being struck (refer to FIG. 2). Additional protection is provided against this contingency by ignoring shadows larger than those possible as a result of ball 500. In the event that no ball 500 is sensed shortly following a successful club head speed measurement, system 20 times out and prepares for the next swing.

Another set of error conditions are possible as a result of light sensors 26 not being illuminated properly by their respective light sources. Four SHADOW TEST BITS are provided, one for each light sensing array 24 and 30 and each club head sensor 48 and 52, that inform system 20 of anything less than complete illumination of all light sensors 26. This data is taken ahead of the four shadow latches to avoid the likely possibility that a reset of a latch occurs during a persistent shadow on a respective sensor, rendering the shadow undetected.

First and second light sensing arrays 24 and 30 each include thirty-two Honeywell SDP8371 precision optoschmitt detectors available from Honeywell Micro Switch, of 11 West Spring Street, Freeport, Ill. 61032. First and second club-head light sensors 48 and 52 are also Honeywell SDP8371 detectors. First and second light sources 28 and 32 are 50 watt PAR 20 halogen spot lamps. Timer card 62 is a Data Translation DT2819 available from Data Translation of 100 Locke Drive, Marlborough, Mass. 01752. First and second 32 bit parallel-in serial-out shift registers 86 and 88 each include four Motorola 74LS166N 8-bit shift registers. First and second shadow detectors 76 and 82 each include three Motorola 74LS133N 13-input NAND gates and one or two Motorola 74LS32N quad 2-input OR gates. First and second ball latches 78 and 84 and first and second club head shadow latches 70 and 74 each include one or two Motorola 74LS74N dual D flip-flops and one to six Motorola 74LS04 hex inverters. First and second exclusive OR gates 80 and 72 each include one to four Motorola 74LS86N quad 2-input exclusive OR gates.

Figure 12:
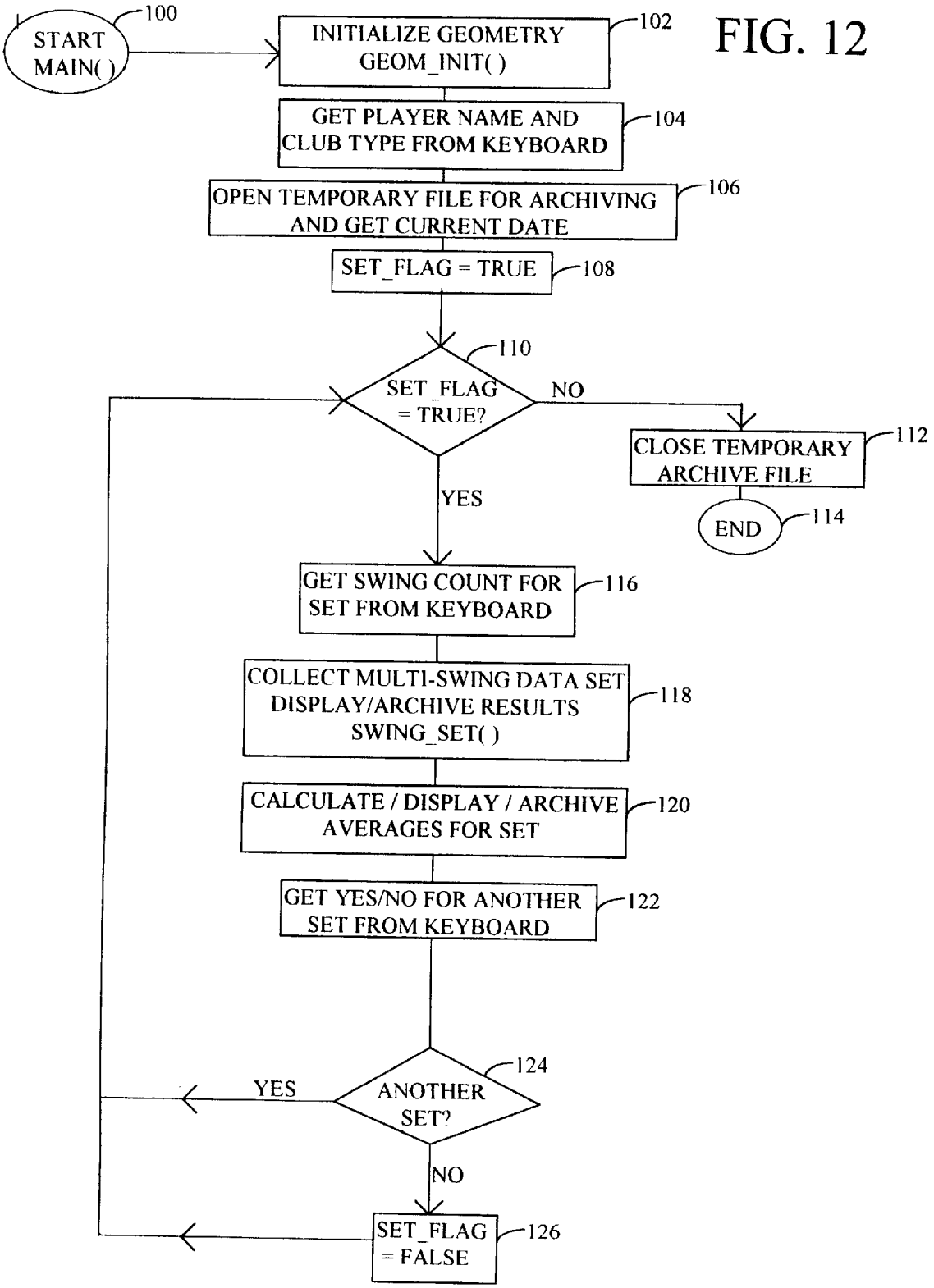
FIG. 12 is a flow chart of the main software program.

FIG. 12 is a flow chart of the main software program. After the program begins at 100 and initial geometric calculations are made at 102, the player is prompted by the computer screen to enter a name and a club type at 104 with the computer keyboard. The current date is then obtained from the computer clock, a temporary file is opened for archiving data at 106 and a flag is set TRUE at 108 enabling a positive decision at 110 to measure a set of swings. The player is then prompted to enter a desired number of swings from the keyboard at 116, after which the program collects data on that number of swings, displaying and archiving the results of each at 118. When the set ends, average values of all data are calculated, displayed and archived at 120, and the player is asked on the computer screen whether another set is to be played at 122. If the answer is yes, the decision at 110 is again made to measure a set of swings. Otherwise, a decision is made at 124 to make the flag enabling a set FALSE. The decision at 110 is then to close the archive file at 112 and end the program at 114.

Figure 13A:
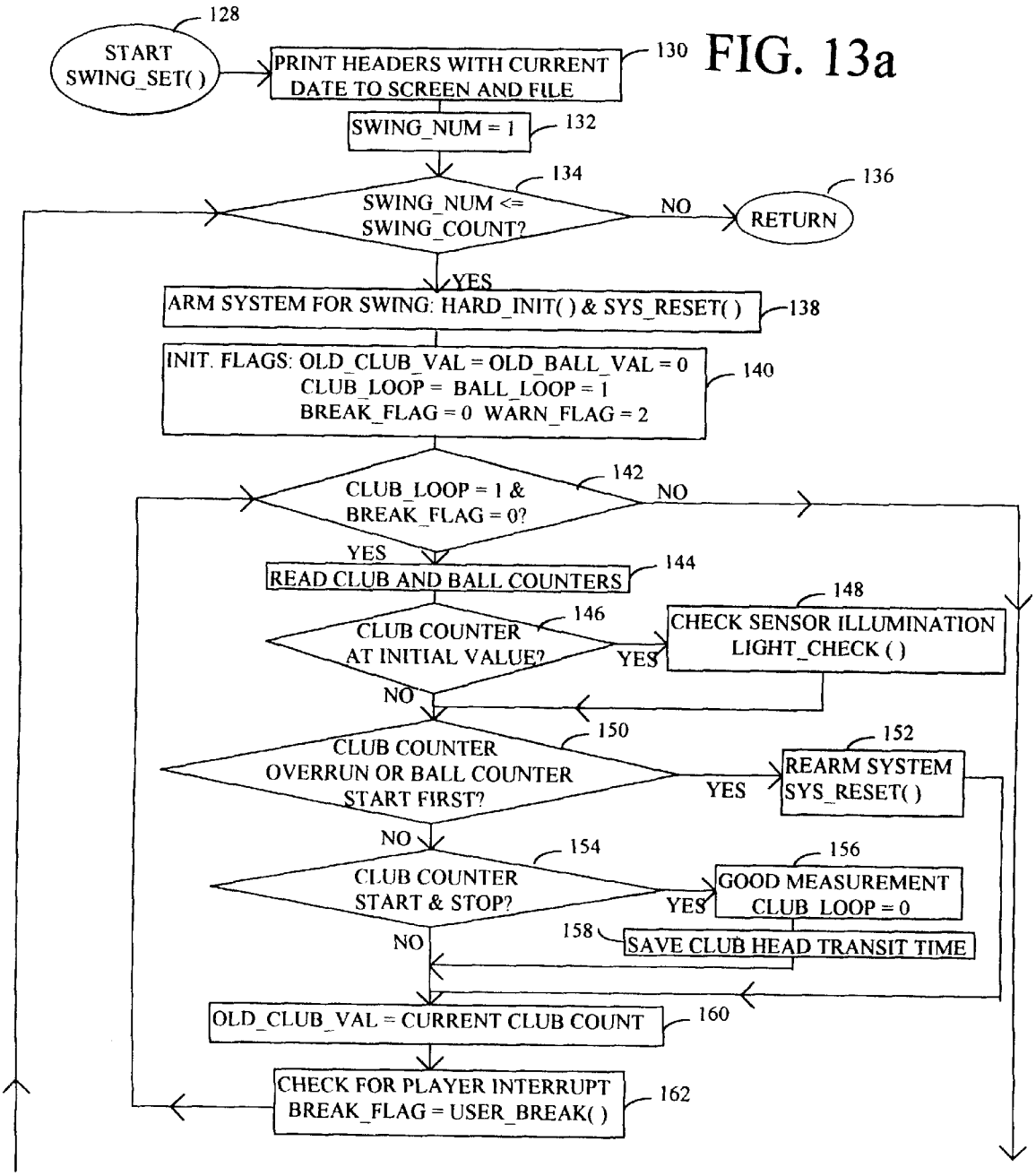
FIG. 13 is a flow chart detailing the subroutine swing_set( ) of FIG. 12.
Figure 13B:
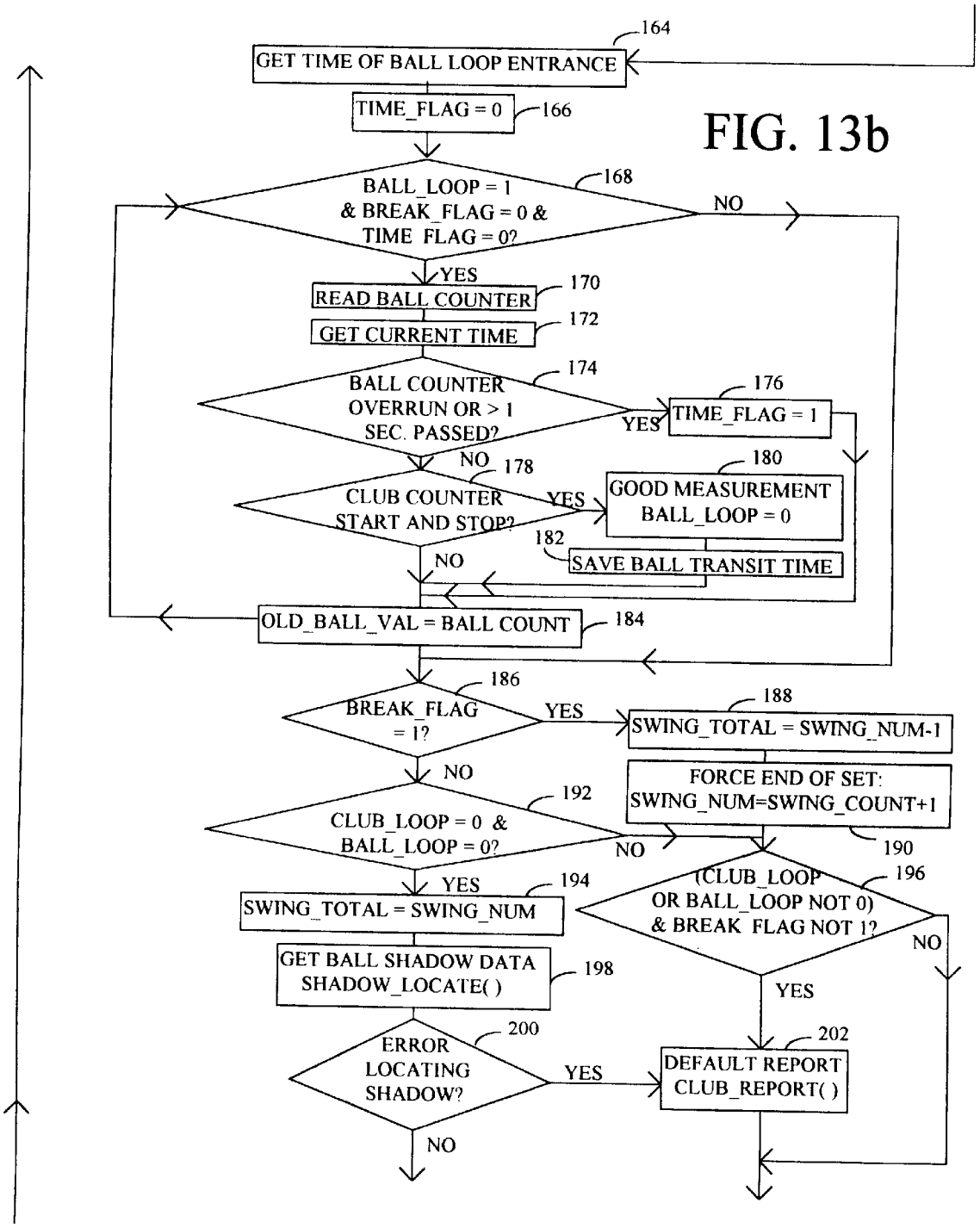
Figure 13C:
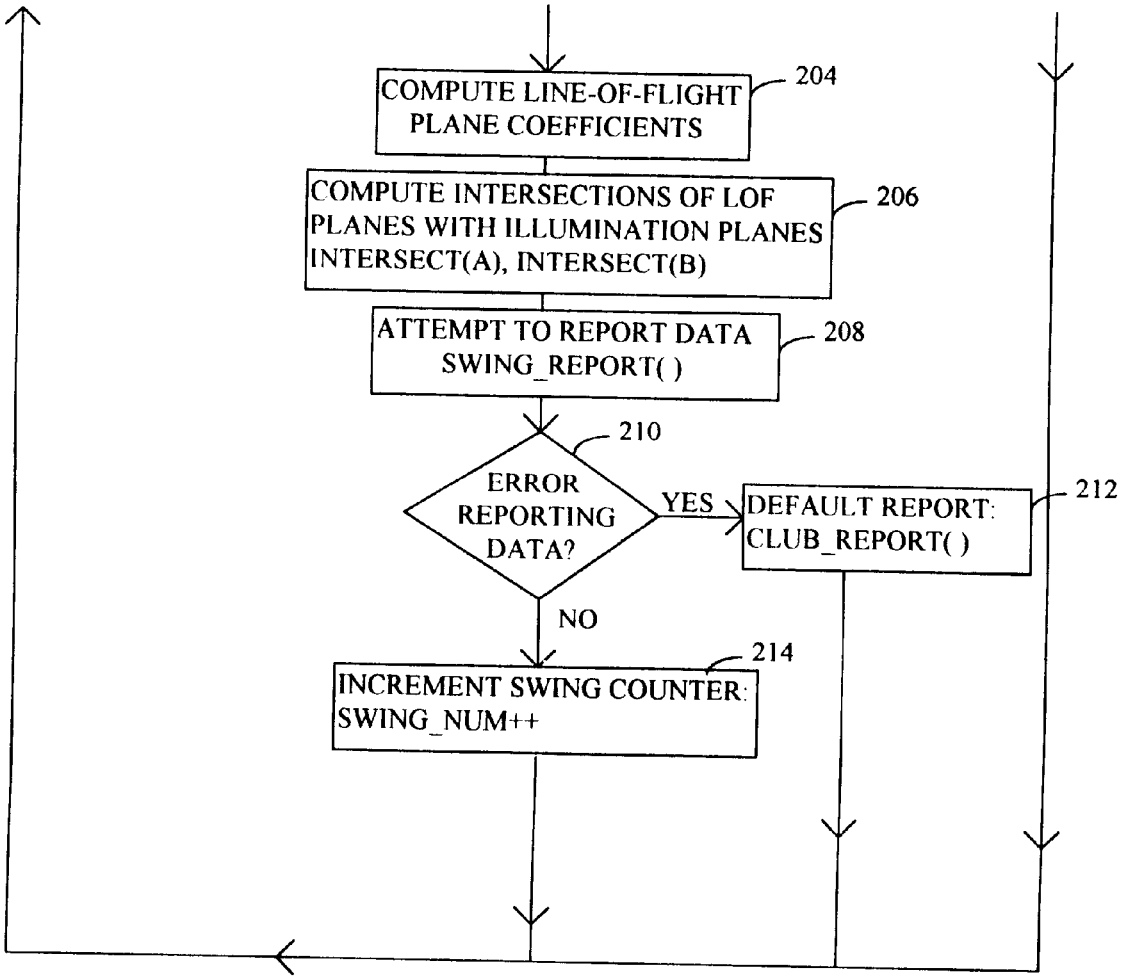

FIG. 13 is a flow chart detailing the subroutine swing_set( ) at 118 of FIG. 12. Following entry at 128, headers including the current date are written to screen and file at 130 and a swing counter is set to unity at 132. The decision is initially affirmative at 134 as to whether the value in the swing counter exceeds the desired total, data collection hardware is initialized and the system is armed for a swing at 138. After setting flags at 140, the club measurement loop is entered at 142. The flag check at 142 is initially answered affirmative and elapsed time of passage between sensors is read from counters for each club and ball at 144. If the club counter is at its initial value at 146, the club head has not been detected and the system checks all sensors for inadvertent shadows at 148, reporting results to the computer screen. If the club counter has overrun, or the ball counter has started prematurely at 150, the system is reset and re-armed at 152. Otherwise, a determination is made as to whether the club counter has both started and stopped at 154. If so, a good measurement of the club head's duration between the club head sensors has been made, the club loop flag is reset at 156, and the transition time is stored. In any event, the club counter reading is saved at 160, a test is made for a user interrupt at 162 and the club loop is reentered at 142. This last occurs even following the reset at 152. This loop will repeat until a proper club measurement has been competed or a user break is detected. When either occur, the real time is read from the computer clock at 164, a time-out flag is reset at 166 and the ball measurement loop is entered at 168. If no break or time-out flag is set, the ball counter is read at 170 and real time is again read from the computer clock at 172. If it is determined at 174 that the ball counter is overrun or more than one second has passed, the time-out flag is set at 176. Otherwise, a determination is made as to whether the ball counter has both started and stopped at 178. If so, a good measurement of the ball's duration between the light sensor arrays has been made and the shadow locations acquired, the ball loop flag is reset at 180, and the transition time is stored at 182. In any event, the ball counter reading is saved at 184 and the ball loop is reentered at 168. This last occurs even following the time-out flag set at 176. This loop will repeat until a proper ball measurement has been competed unless a user break is detected or a time-out occurs. Once out of this loop, if no user break is detected at 186 and both club and ball loop flags are reset at 192, a swing total is set equal to the current value of the swing counter at 194 and ball shadow data is read and processed at 198. If no shadow processing errors occurred, as determined at 200, line-of-flight plane coefficients are calculated at 204 as are their intersection points with the planes of illumination at 206 and data is reported (if no further errors detected) to screen and file. The swing number is incremented and the swing loop is reentered at 134. If a user break was detected at 186, the swing total is set to on less than the current swing number at 188 and the swing number is then set to exceed the desired swing count, later forcing an end to the set. If both club and ball transit times were not measured at 192, a default report of club speed at 202 will be made to the screen only if available, as determined at 196. This default report will also be made if an error occurred while processing ball shadow data at 200. The same default report is made at 212 if a ball data reporting error occurred at 210.

Figure 14A:
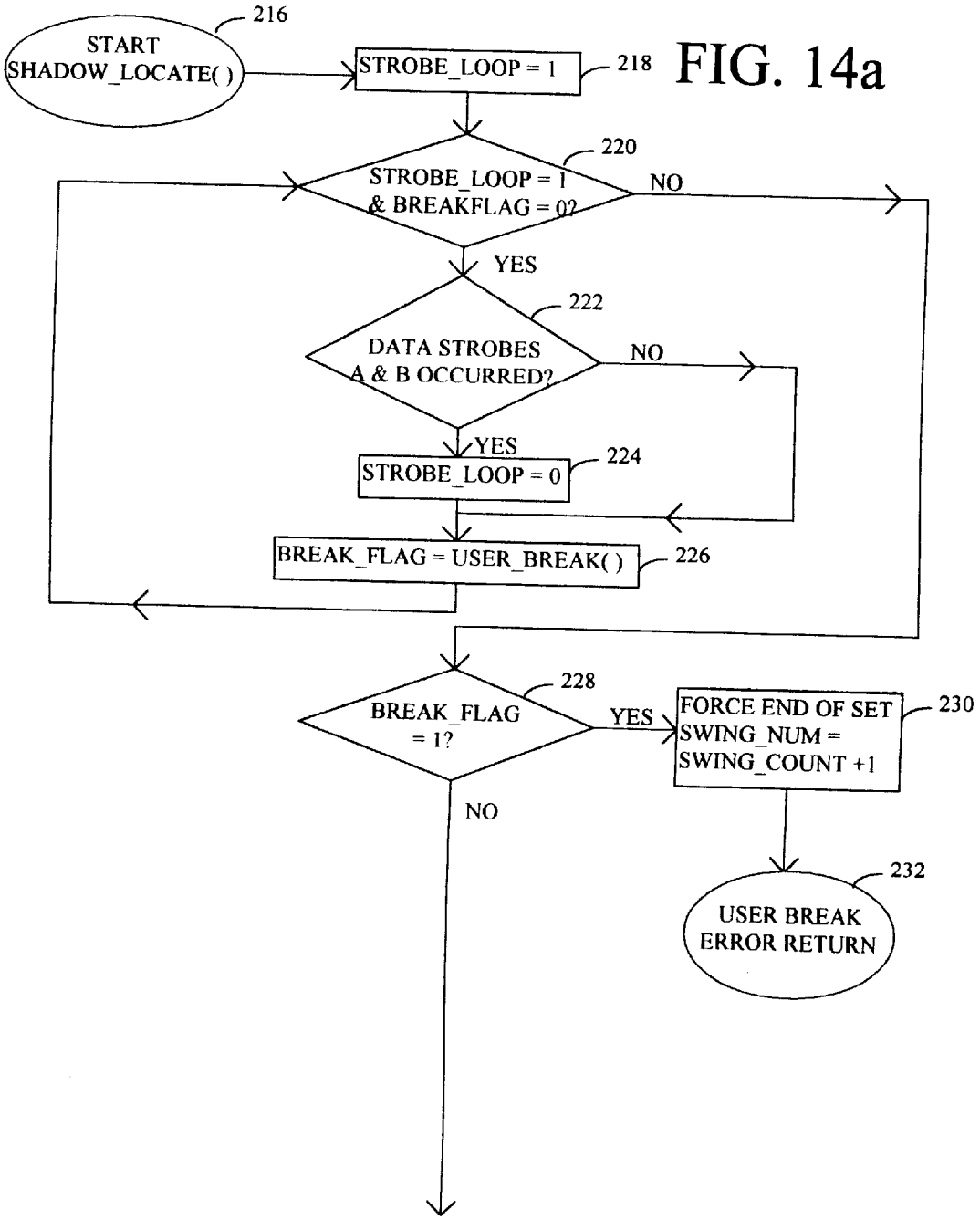
FIG. 14 is a flow chart detailing the subroutine shadow_locate( ) of FIG. 13.
Figure 14B:
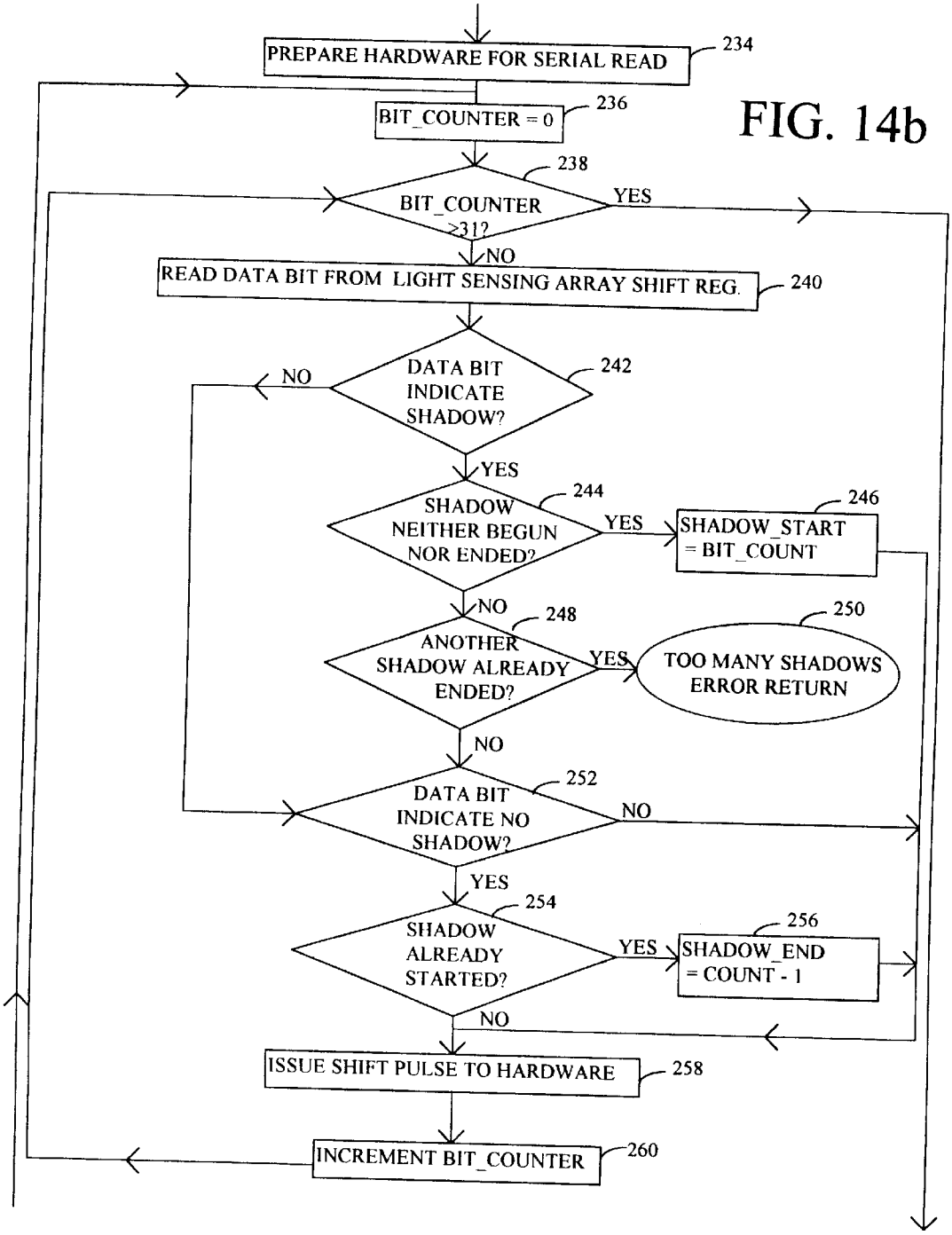
Figure 14C:
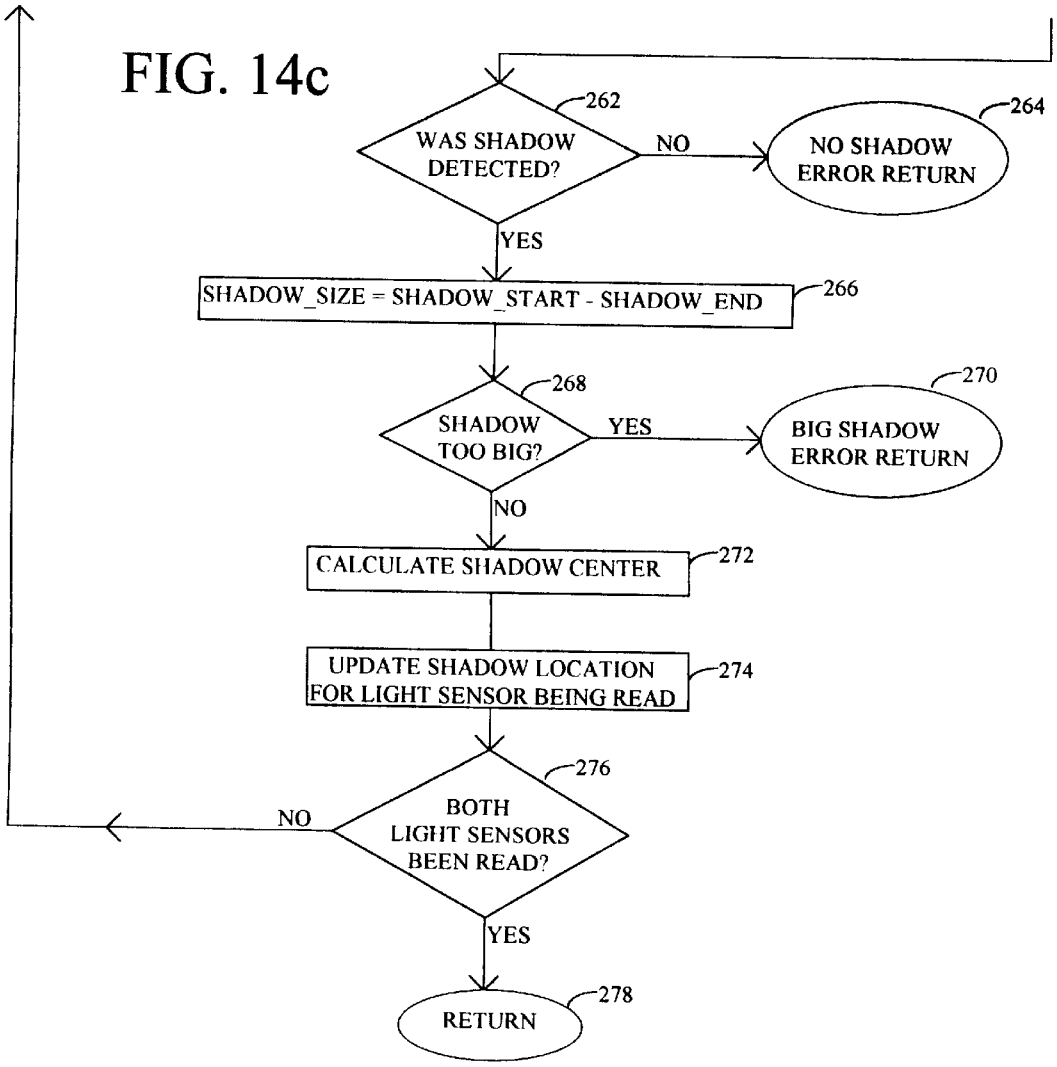

FIG. 14 is a flow chart detailing the subroutine shadow_locate( ) at 198 of FIG. 13. Following entry at 216, a strobe loop flag is set at 218 and the strobe loop is entered. The decision at 220 is initially affirmative as to whether the strobe loop flag is set and, if a user break has not occurred, hardware is tested for the occurrence of strobe pulses (first and second parallel clocks), suitably delayed, that latch an image of the ball shadows in respective hardware registers. If both strobes have occurred, as determined at 222, the strobe loop flag is reset at 224. In any case, a user break is checked for at 226 and the strobe loop reentered at 220. When the loop is finally exited, and the exit is due to proper data strobes and not a user break as determined at 228, hardware is prepared for serial data read at 234, a bit counter is set to zero at 236 and a data read loop is entered at 238 where it is determined whether data from a full sensor array has been read. If not, a single data bit is read at 240 and it is determined at 242 if this bit represents a shadowed sensor element. If not, the bit will be determined not to be a shadow bit at 252. If a shadow has not been detected on a previous bit, as determined at 254, a serial register shift clock is issued to the hardware at 258, the bit counter is incremented 260 and the data read loop is reentered at 238. Had the unshadowed bit been preceded by a shadowed bit, as determined at 254, a shadow end is marked as one less than the current bit count at 256 prior to issuing the shift clock at 258. If the bit is indicative of a shadow, as determined at 242, it is then determined at 244 whether no prior bits for this sensor array were in shadow. If this is the first shadow bit, a shadow start is marked at the current bit count at 246 and the path proceeds to the shift clock at 258. If prior shadow bits have occurred, it is determined whether a shadow has begun and ended prior to the current bit at 248. If not, the bit is in the middle of a shadow, the path proceeds through 252, determining again a shadowed bit, and then immediately to the shift clock at 258. However, if it was determined at 248 that a shadow had indeed begun and ended, the current bit would represent the start of a second shadow, resulting in an error return at 250. When the data read loop has read 32 bits as determined at 238, it is determined at 262 whether any shadow was detected. If so, the width of the shadow in number of shadowed sensor elements is determined at 266. If the shadow width does not exceed a predetermined maximum as determined at 268, a shadow center in global coordinates is determined at 272, and the data is stored at 274. If it was determined at 262 that no shadow was detected, an error return occurs at 264. If the shadow width exceeds a predetermined maximum as determined at 268, an error return occurs at 270. If no errors occur, it is determined at 276 whether another ball sensor array remains to be read. If so, the program is reentered prior to the resetting of the bit counter at 236. Otherwise, an error free return occurs at 278.

Figure 15:
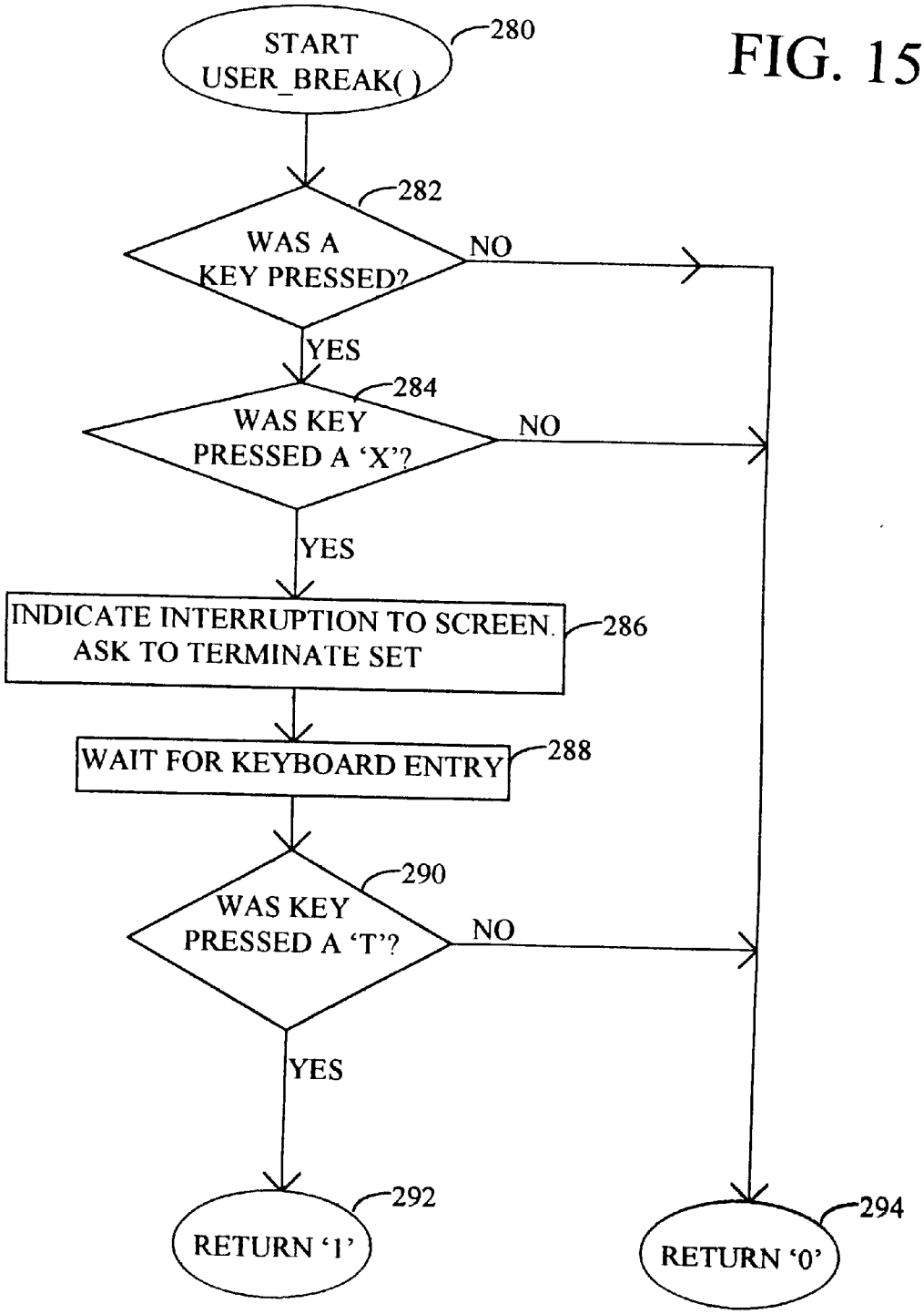
FIG. 15 is a flow chart of the subroutine user_break ( ), as called for example in FIG. 14 to determine if a key has been pressed; and, FIG. 16 is a flow chart of subroutine club_report( ), a default report of club speed to the screen when no ball data is available, as called for in FIG. 13.

FIG. 15 is a flow chart of the subroutine user_break ( ), as called for example in FIG. 14 at 226 to determine if a key has been pressed. Following entry at 280, the computer operating system is queried at 282 as to whether a key has been pressed since the last such query. If so, the key entered is read and it is determined at 284 if a lower case 'x' was pressed. If this is also the case, the player is informed at 286 by the computer screen that the set has been interrupted. The player is also prompted at 286 to verify a desire to terminate the set by entering a lower case 't' or resume playing the set by entering any other character. When the program reads the player's entry at 288 and determines it to be a 't' at 290, the value '1' is returned to the calling program at 292, indicating that set termination is desired. If however, a key was not pressed, as determined at 282, or the key was not an 'x' as determined by 284 or the verifying entry was not a 't' as determined at 290, a '0' is returned by the calling program at 294.

Figure 16:
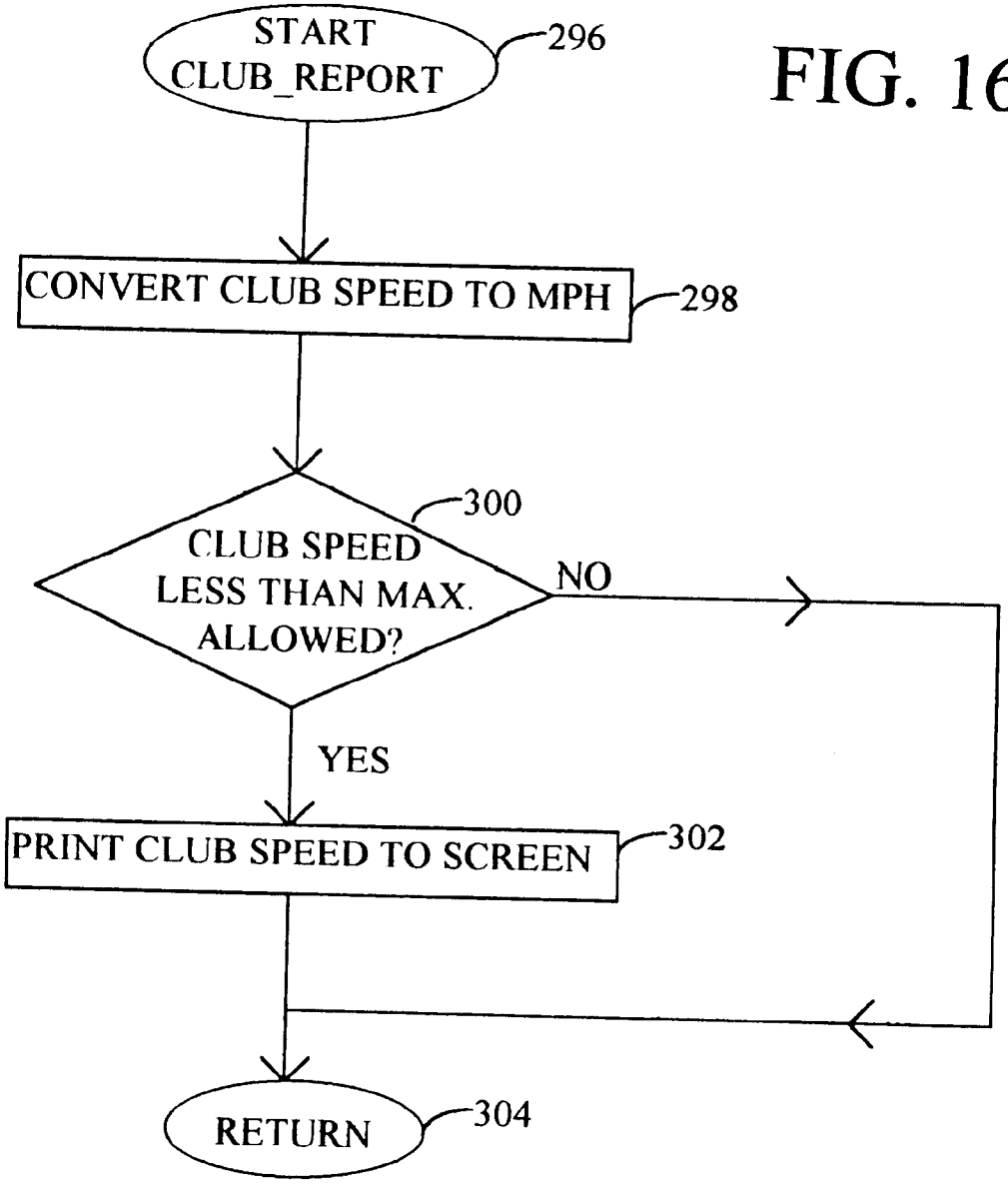

FIG. 16 is a flow chart of subroutine club_report( ), a default report of club speed to the screen when no ball data is available, as called for example in FIG. 13 at 212. Following entry at 296, the previously calculated club speed is converted to units of miles-per-hour (MPH) at 298 and compared with a maximum reportable speed at 300. If less than this maximum reportable speed, the club speed is then printed to the screen at 302 and control is returned to the calling program at 304. If however it had been determined at 300 that the maximum reportable speed was exceeded, the club speed measurement is deemed spurious and control is returned to the calling program at 300 with no report having been provided.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A system for measuring an initial line of flight of a ball, comprising:

the ball having an initial position;

a first light sensing array having a plurality of light sensors;

a first light source directed toward said first light sensing array;

the ball having a first position interposed between said first light sensing array and said first light source;

a first shadow position on said first light sensing array caused by the ball being interposed between said first light sensing array and said first light source, said first shadow position including a shadow cast upon at least one light sensor;

a first plane defined by (1) said initial position, (2) said first shadow position, and (3) said first light source;

a second light sensing array having a plurality of light sensors, said second light sensing array oriented substantially parallel to and disposed a predetermined distance D from said first light sensing array;

a second light source directed toward said second light sensing array;

the ball having a second position interposed between said second light sensing array and said second light source;

a second shadow position on said second light sensing array caused by the ball being interposed between said second light sensing array and said second light source, said second shadow position including a shadow cast upon at least one light sensor;

a second plane defined by (1) said initial position, (2) said second shadow position, and (3) said second light source; and, said initial line of flight defined by the intersection of said first plane with said second plane.

2. A system according to claim 1, wherein said line of flight is calculated in accordance with standard principles of analytic geometry.

3. A system according to claim 1, further including means for ensuring that the maximum number of light sensors are shadowed.

4. A system according to claim 3, wherein said means for ensuring includes a delay circuit which delays the measurement of said first and second shadow positions until the ball is substantially directly over said first and second light sensing arrays respectively.

5. A system according to claim 1, further including:

the ball being interposed between said first light sensing array and said first light source at a time T1;

the ball being interposed between said second light sensing array and said second light source at a time T2;

a slant distance $D_s$ measured from the position of the ball at time T1 to the position of the ball at time T2; and, an initial speed $S_b$ defined by the equation $S_b=D_s/(T2-T1)$.

6. A system according to claim 5, wherein said time interval T2−T1 is measured by a timer card.

7. The system according to claim 5, wherein said slant distance $D_s$ is calculated in accordance with standard principles of analytic geometry.

8. A system according to claim 1, further including:

a golf club head;

a first club head light sensor;

a first club head light source directed toward said first club head light sensor;

the golf club head having a first position interposed between said first club head light sensor and said first club head light source;

a second club head light sensor disposed a predetermined distance $D_c$ from said first club head light sensor;

a second club head light source directed toward said second club head light sensor;

the golf club head having a second position interposed between said second club head light sensor and said second club head light source;

the golf club head being interposed between said first club head light sensor and said first club head light source at a time T3;

the ball being interposed between said second club head light sensor and said second club head light source at a time T4;

the golf club head having a speed $S_c$ defined by the equation $S_c=D_c/(T4-T3)$.

9. A system according to claim 8, wherein said interval T4−T3 is measured by a timer card.

10. A system according to claim 8, wherein said golf club head speed $S_c$ must be greater than a predetermined value.

11. A system according to claim 8, said ball having an initial speed $S_b$, wherein $S_b$ must be a predetermined amount greater than said golf club head speed $S_c$.

12. A system for measuring an initial line of flight, an initial speed, and an initial velocity vector of a ball, comprising:

the ball having an initial position;

a first light sensing array having a plurality of light sensors;

a first light source directed toward said first light sensing array;

the ball having a first position interposed between said first light sensing array and said first light source;

a first shadow position on said first light sensing array caused by the ball being interposed between said first light sensing array and said first light source, said first shadow position including a shadow cast upon at least one light sensor;

a first plane defined by (1) said initial position, (2) said first shadow position, and (3) said first light source;

a second light sensing array having a plurality of light sensors, said second light sensing array oriented substantially parallel to and disposed a predetermined distance D from said first light sensing array;

a second light source directed toward said second light sensing array;

the ball having a second position interposed between said second light sensing array and said second light source;

a second shadow position on said second light sensing array caused by the ball being interposed between said second light sensing array and said second light source, said second shadow position including a shadow cast upon at least one light sensor;

a second plane defined by (1) said initial position, (2) said second shadow position, and (3) said second light source;

said initial line of flight defined by the intersection of said first plane with said second plane;

the ball being interposed between said first light sensing array and said first light source at a time T1;

the ball being interposed between said second light sensing array and said second light source at a time T2;

a slant distance $D_s$ measured from the position of the ball at time T1 to the position of the ball at time T2;

said initial speed $S_b$ defined by the equation $S_bD_s/(T2-T1)$; and, said initial velocity vector comprised of said initial speed $S_b$ directed along said initial line of flight.

13. A method for measuring the initial line of flight of a ball having an initial position, comprising the steps of:

providing a first light sensing array having a plurality of light sensors, a first light source directed toward said first light sensing array, at time T1 the ball having a first position interposed between said first light sensing array and said first light source, a first shadow position on said first light sensing array caused by the ball being interposed between said first light sensing array and said first light source, said first shadow position including a shadow cast upon at least one light sensor;

defining a first plane by (1) said initial position, (2) said first shadow position, and (3) said first light source;

providing a second light sensing array having a plurality of light sensors, said second light sensing array oriented substantially parallel to and disposed a predetermined distance D from said first light sensing array, a second light source directed toward said second light sensing array, at time T2 the ball having a second position interposed between said second light sensing array and said second light source, a second shadow position on said second light sensing array caused by the ball being interposed between said second light sensing array and said second light source, said second shadow position including a shadow cast upon at least one light sensor;

defining a second plane by (1) said initial position, (2) said second shadow position, and (3) said second light source; and, calculating said initial line of flight as the intersection of said first plane with said second plane.

14. The method of claim 13, further including the steps of:

calculating a slant distance $D_s$ between said first position of the ball and said second position of the ball; and, calculating an initial speed of the ball $S_b$ defined by the equation $S_b=D_s/(T2-T1)$.

15. The method of claim 14, further including the step of:

calculating an initial velocity vector comprised of said initial speed $S_b$ directed along said initial line of flight.

* * * * *